US007699412B2

(12) United States Patent
Heimler et al.

(10) Patent No.: US 7,699,412 B2
(45) Date of Patent: Apr. 20, 2010

(54) STORAGE UNIT

(75) Inventors: James R. Heimler, Oak Creek, WI (US); Mark A. Thielke, Menomonee Falls, WI (US); Thomas E. Pelt, Menomonee Falls, WI (US); Jon Dommisse, West Bend, WI (US); Todd Morris, Watertown, WI (US); Adam Perry, Marysville, OH (US)

(73) Assignee: The Mills Company Inc., Sandusky, OH (US)

( * ) Notice: Subject to any disclaimer, the term of this patent is extended or adjusted under 35 U.S.C. 154(b) by 213 days.

(21) Appl. No.: 11/740,782

(22) Filed: Apr. 26, 2007

(65) Prior Publication Data

US 2008/0024045 A1 Jan. 31, 2008

Related U.S. Application Data

(63) Continuation-in-part of application No. 11/405,267, filed on Apr. 17, 2006, now Pat. No. 7,278,695, which is a continuation of application No. 10/770,165, filed on Feb. 2, 2004, now Pat. No. 7,029,078, which is a continuation of application No. 10/143,552, filed on May 10, 2002, now Pat. No. 6,685,285.

(60) Provisional application No. 60/290,132, filed on May 10, 2001.

(51) Int. Cl.
*E05B 65/46* (2006.01)
*E05C 9/10* (2006.01)

(52) U.S. Cl. ..... 312/217; 312/216; 312/220

(58) Field of Classification Search ..... 70/120, 70/78, 79, 81, 84; 312/220, 216, 217, 199
See application file for complete search history.

(56) References Cited

U.S. PATENT DOCUMENTS

| | | | |
|---|---|---|---|
| 359,402 | A | 3/1887 | Paff |
| 449,936 | A | 4/1891 | Jackson |
| 498,178 | A | 5/1893 | Leonard |
| 537,844 | A | 4/1895 | Moore et al. |

(Continued)

FOREIGN PATENT DOCUMENTS

| | | | |
|---|---|---|---|
| EP | 0 516 961 | A1 | 12/1992 |

(Continued)

OTHER PUBLICATIONS

Brochure-Bradley Corporation-Lenox Solid Plastic Lockers and Benches (One Source Central) 4 pgs.

(Continued)

*Primary Examiner*—Amy J Sterling
(74) *Attorney, Agent, or Firm*—Foley & Lardner LLP

(57) ABSTRACT

A locker is provided. The locker comprises a base defining a storage space, a door coupled to the base and rotatable relative to the base between an open position and a closed position, and a latch bar supported at an interior side of the door by at least one projection that engages at least one guide slot in the latch bar. The latch bar is moveable parallel to the door between an extended position and a retracted position. The latch bar is biased toward the extended position to secure the panel in the closed position. The extended position is horizontally and vertically offset from the retracted position.

36 Claims, 14 Drawing Sheets

U.S. PATENT DOCUMENTS

| | | | | |
|---|---|---|---|---|
| 669,171 | A | | 3/1901 | Jefferis |
| 726,555 | A | | 4/1903 | Mayer |
| 810,415 | A | | 1/1906 | Jefferis |
| 894,504 | A | | 7/1908 | Jefferis |
| 1,488,375 | A | | 3/1924 | Bowers |
| 1,548,371 | A | | 8/1925 | Moore |
| 1,806,031 | A | | 5/1931 | Vignos |
| 1,967,506 | A | | 7/1934 | Harrison |
| 1,970,267 | A | | 8/1934 | Bales |
| 2,144,136 | A | | 1/1939 | Albach |
| 2,195,223 | A | | 3/1940 | O'Connor |
| 2,555,366 | A | | 6/1951 | Peters et al. |
| 2,717,064 | A | | 9/1955 | Hock |
| 2,740,284 | A | | 4/1956 | Gray |
| 2,912,271 | A | | 11/1959 | Schaefer |
| 3,346,309 | A | | 10/1967 | Mellion |
| 3,479,769 | A | | 11/1969 | Diack |
| 3,531,172 | A | | 9/1970 | Schnarr |
| 3,637,246 | A | | 1/1972 | Leiter |
| 3,675,808 | A | | 7/1972 | Brink |
| 3,819,246 | A | | 6/1974 | List |
| 3,887,101 | A | | 6/1975 | Adachi |
| 4,098,424 | A | | 7/1978 | Liebscher et al. |
| 4,099,293 | A | | 7/1978 | Pittasch |
| 4,226,348 | A | | 10/1980 | Dottor et al. |
| 4,369,993 | A | | 1/1983 | Rodriguez |
| 4,391,386 | A | | 7/1983 | Moret |
| 4,447,099 | A | | 5/1984 | French et al. |
| 4,615,464 | A | | 10/1986 | Byrns |
| 4,629,265 | A | | 12/1986 | Chester |
| 4,674,776 | A | | 6/1987 | James |
| 4,852,920 | A | | 8/1989 | DeForrest, Sr. |
| 5,005,881 | A | | 4/1991 | Bailey et al. |
| 5,074,602 | A | | 12/1991 | Hwang |
| 5,320,239 | A | | 6/1994 | Favre |
| 5,339,659 | A | * | 8/1994 | Guzzinati ..... 70/120 |
| 5,360,246 | A | | 11/1994 | Leiter et al. |
| 5,372,415 | A | | 12/1994 | Tisbo et al. |
| 5,470,115 | A | | 11/1995 | Berg et al. |
| 5,490,604 | A | | 2/1996 | Alexander |
| 5,573,322 | A | | 11/1996 | Wrobel |
| 5,595,426 | A | | 1/1997 | Wolff et al. |
| 5,673,984 | A | | 10/1997 | Insalaco et al. |
| 5,683,124 | A | | 11/1997 | Karpisek |
| 5,791,174 | A | | 8/1998 | Fitzgerald et al. |
| 5,802,801 | A | | 9/1998 | Hohns et al. |
| 5,951,126 | A | | 9/1999 | Wolff et al. |
| 6,053,354 | A | | 4/2000 | Niemeyer |
| 6,242,832 | B1 | | 6/2001 | Lamb |
| 6,357,806 | B1 | | 3/2002 | Saku |
| 6,398,325 | B1 | | 6/2002 | Chen et al. |
| 6,450,599 | B1 | | 9/2002 | Mamuyac |
| 6,478,071 | B1 | | 11/2002 | Workman et al. |
| 6,486,399 | B1 | | 11/2002 | Armstrong et al. |
| 6,525,644 | B1 | | 2/2003 | Stillwagon |
| 6,535,379 | B1 | | 3/2003 | Smeenge, Jr. et al. |
| 6,691,964 | B1 | | 2/2004 | Schaefer |
| 2003/0196112 | A1 | | 10/2003 | Beuchat et al. |

FOREIGN PATENT DOCUMENTS

| | | |
|---|---|---|
| WO | WO 94/15055 | 7/1994 |

OTHER PUBLICATIONS

Brochure-Bradley Corporation-Lockers, 4 pgs.
Locker of a type understood to be commercially available from Santana Products (nine photographs, nine pgs.).

* cited by examiner

STORAGE UNIT

CROSS-REFERENCE TO RELATED PATENT APPLICATIONS

The present application is a continuation-in-part application of U.S. application Ser. No. 11/405,267, filed Apr. 17, 2006 and titled "Storage Unit," which is a continuation application of U.S. application Ser. No. 10/770,165, filed Feb. 2, 2004 and titled "Storage Unit," now U.S. Pat. No. 7,029,078, which is a continuation application of U.S. application Ser. No. 10/143,552, filed May 10, 2002 and titled "Latch Mechanism for Locker," now U.S. Pat. No. 6,685,285, which claims priority to U.S. Provisional Patent Application No. 60/290,132 titled "Storage Unit" filed May 10, 2001, the full disclosures of which are hereby incorporated herein by reference.

BACKGROUND

The present disclosure relates generally to a storage unit. More particularly, the present disclosure relates to a latch mechanism for the storage unit.

It is known to provide a storage unit, such as a locker, for use in a workplace, or other institutional, public, government, educational, commercial, or municipal facility such as schools, health clubs, athletic facilities, parks, aquatic centers, military facilities, food processing plants, police departments, recreation centers, theme parks, transportation facilities (e.g., airports, bus stops, train stations, etc.), and the like. Known storage units typically include a plurality of walls, a door, and a latch mechanism, and may be made from plastic, metal, and other materials.

However, known storage units may present disadvantages, such as a large amount of material waste generated during fabrication, a large number of parts to assemble the latch mechanism, restrictive tolerances or undue precision required for assembly and installation of the latch mechanism, cost and time burden in assembly, the costs of skilled labor, inspection and occasional repair or quality control during and after assembly or installation, and other problems that tend to be associated with assembling and installing such known storage units.

Accordingly, it would be advantageous to provide a less costly storage unit that is of a configuration that is relatively easy to assemble and install. It would also be advantageous to provide a storage unit that generates less material waste during fabrication. It would also be advantageous to provide a storage unit that is constructed of fewer components and/or fabricated from fewer parts (e.g., integrally molded or machined).

It would further be advantageous to provide a storage unit with or providing any one or more of these or other advantageous features.

SUMMARY

The present invention relates to a locker. The locker comprises a base defining a storage space, a door coupled to the base and rotatable relative to the base between an open position and a closed position, and a latch bar supported at an interior side of the door by at least one projection that engages at least one guide slot in the latch bar. The latch bar is moveable parallel to the door between an extended position and a retracted position. The latch bar is biased toward the extended position to secure the panel in the closed position. The extended position is horizontally and vertically offset from the retracted position.

The present invention also relates to a locker. The locker comprises a base, a door coupled to the base and rotatable relative to the base between an open position and a closed position and a latch bar supported at an interior side of the door by at least one projection that engages at least one guide in the latch bar. The latch bar is moveable parallel to the door between an extended position and a retracted position. The locker further comprises a handle accessible from an exterior side of the door and configured for rotational movement. The rotation of the handle moves the latch bar between the extended position and the retracted position. The extended position is horizontally and vertically offset from the retracted position.

The present invention further relates to a locker. The locker comprises a base defining a storage space, a door coupled to the base and rotatable relative to the base between an open position and a closed position, and a latch bar supported at an interior side of the door by at least one projection that engages at least one guide slot in the latch bar. The latch bar is moveable parallel to the door between an extended position and a retracted position. The at least one guide slot extends in both a horizontal and vertical direction. The latch bar has a weight that biases the latch bar toward the extended position to secure the panel in the closed position.

The present invention further relates to various features and combinations of features shown and described in the disclosed embodiments.

DETAILED DESCRIPTION

Figure 1:
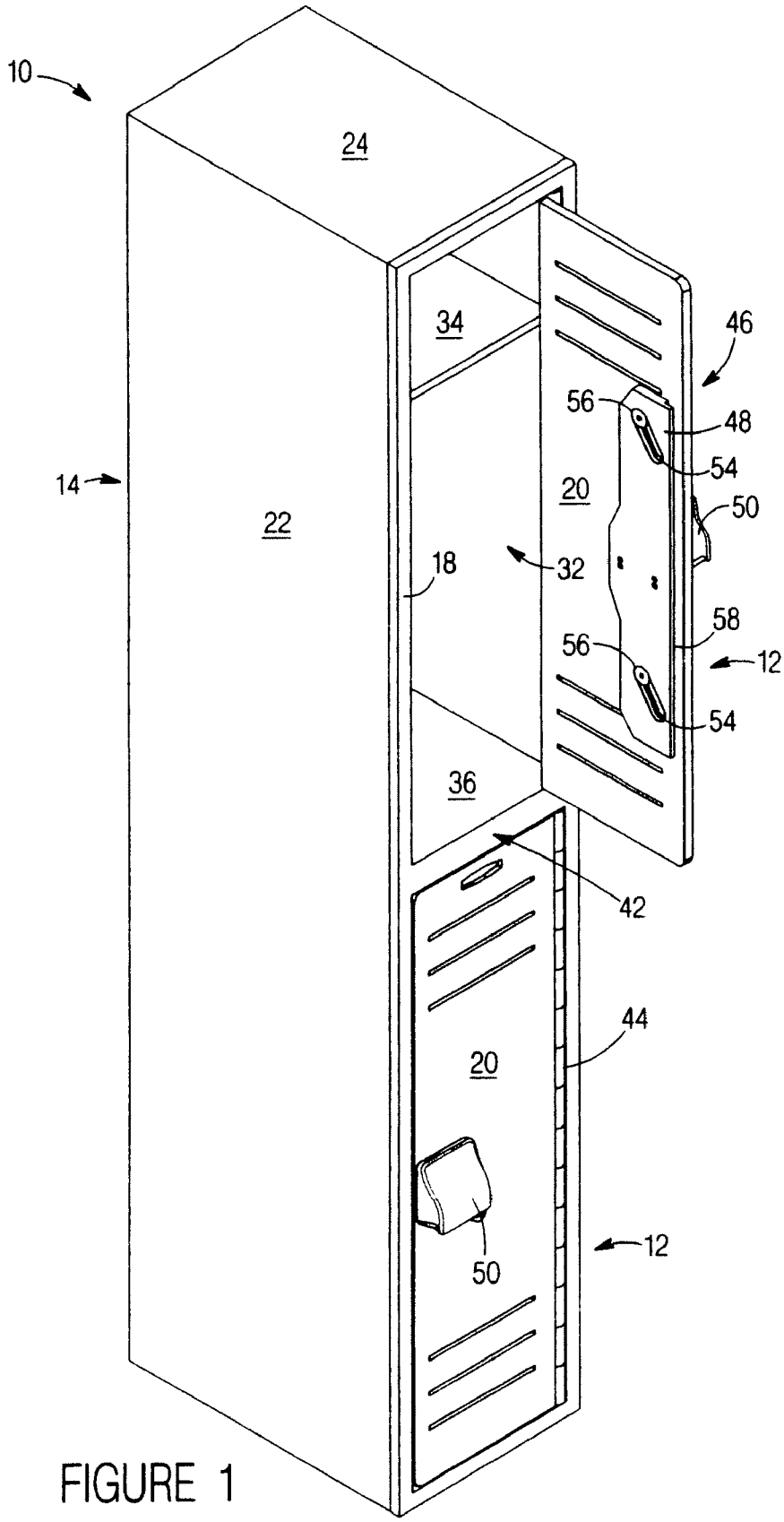
FIG. 1 is a perspective view of a locker system according to a preferred embodiment.
Figure 2:
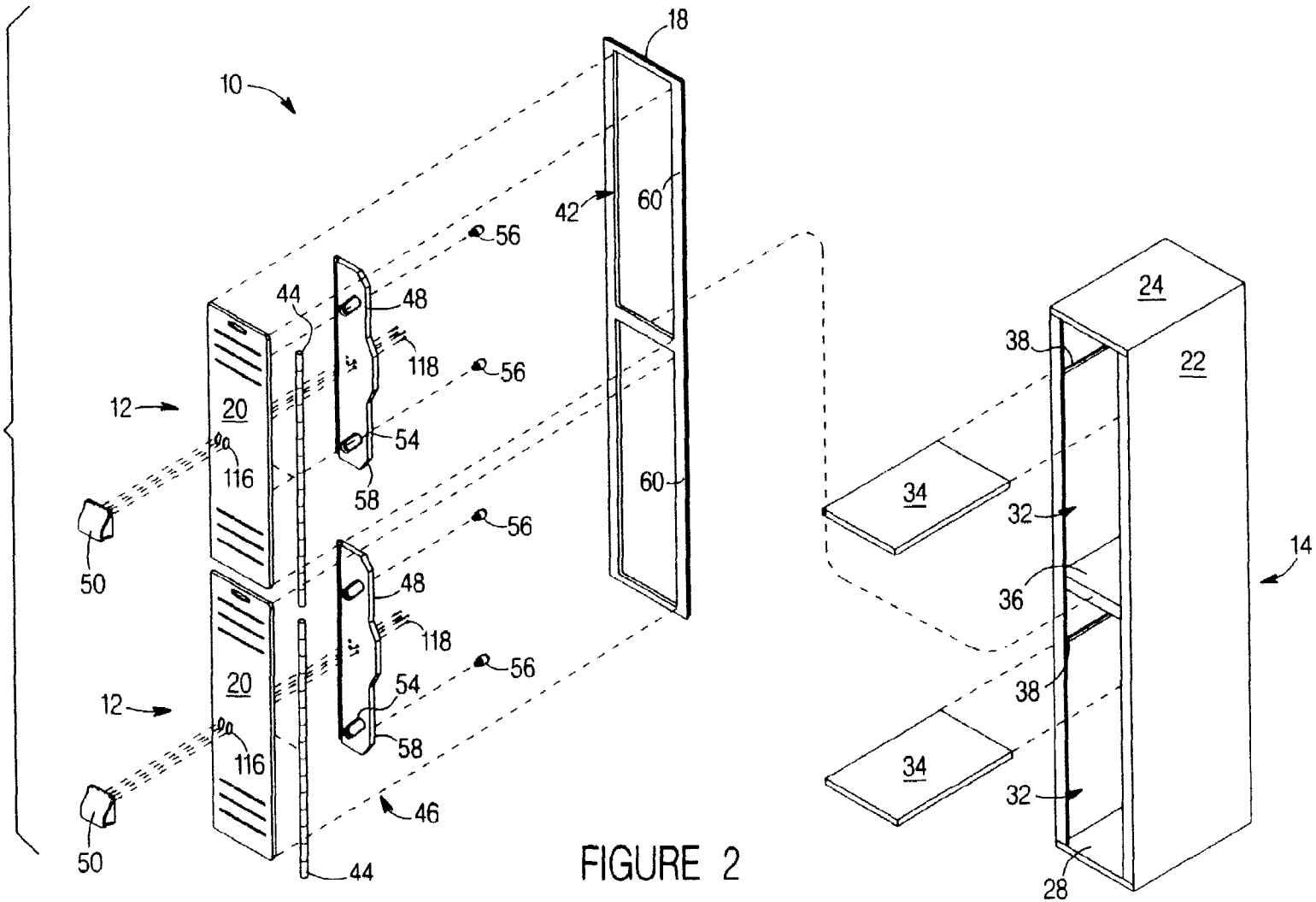
FIG. 2 is an exploded view of the locker system of FIG. 1.

As shown in the FIGS. 1 and 2, a storage unit (shown as a locker system 10 having one or more lockers 12) is configured to provide improved (among other things) manufacturing and assembly, and functionality. Locker 12 includes a base (shown as a box 14 and a frame 18, or one or more other components), and a panel (shown as a door 20).

Box 14 includes a plurality of walls (e.g., a pair of side walls 22, a top wall 24, a rear wall, and a bottom wall 28) and a front member 30 that define an interior storage space 32. According to exemplary embodiments, box 14 may have any of a variety of configurations, shapes, sizes, number of walls, etc. (For example, the box may be made of one or more walls that may provide a rectangular space or a non-rectangular space (e.g., circular, arcuate, ovular, elliptical, cylindrical, etc.). Space 32 may be configured to include one or more shelves 34, hooks, and other accessories or options intended to provide for a variety of storage arrangements. A panel (shown as a divider 36) may be included to provide multiple lockers 12 for a single box 14.

Side walls 22, rear wall, and front members 30 of box 14 may be fabricated using any of a variety of techniques. According to exemplary embodiments, the walls may be secured together using dove tail joints, welding, adhesive, and/or fasteners (e.g., screws, bolts, pins, etc.). According to a preferred embodiment, the walls are formed from a single sheet of material. According to a particularly preferred embodiment, a plastic weld gun is used to secure the walls, shelf and/or divider in place with a plurality of welds. The weld gun may be any of a variety of commercially available weld guns configured to melt adjacent material (e.g., with heat) and/or apply a bonding material (e.g., melted plastic, adhesive, etc.). According to an alternative embodiment, the shelves are secured in place before the box is formed.

Figure 6:
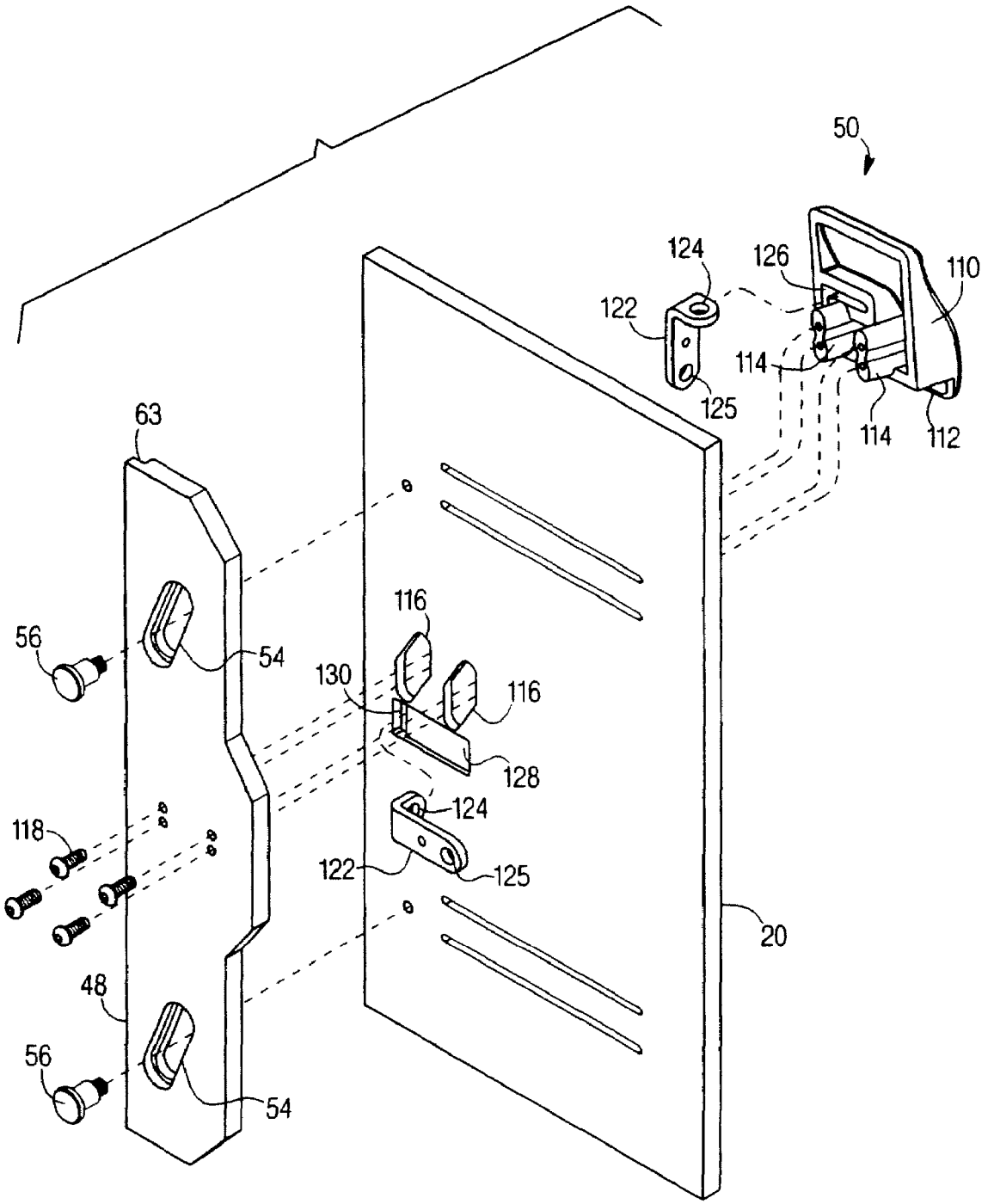
FIG. 6 is an exploded fragmentary perspective view of a handle assembly according to a preferred embodiment.

Referring to FIGS. 2 and 6, frame 18 is secured to front members 30 and is intended to provide a front surface 42 for locker 12. Frame 18 may be attached using any of a variety of techniques (e.g., dove tail joints, fasteners, adhesive, welding etc.). According to a preferred embodiment, frame 18 and box 14 are joined (e.g., welded, fused, bonded, etc.). According to a particularly preferred embodiment, a plastic weld gun is used to secure the frame in place with a plurality of welds on the top and bottom, and near the underside of the divider. According to an alternative embodiment, the frame is attached to the side walls using any of a variety of methods (e.g., mechanical fasteners, etc.).

Figure 3:
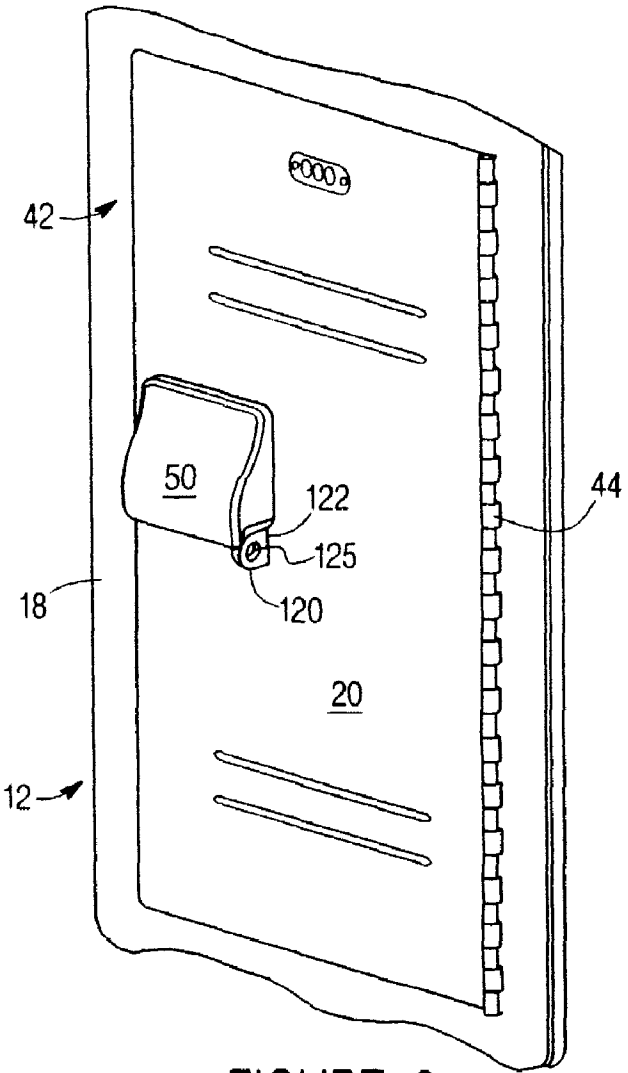
FIG. 3 is a fragmentary perspective view from outside the locker of FIG. 1.
Figure 7:
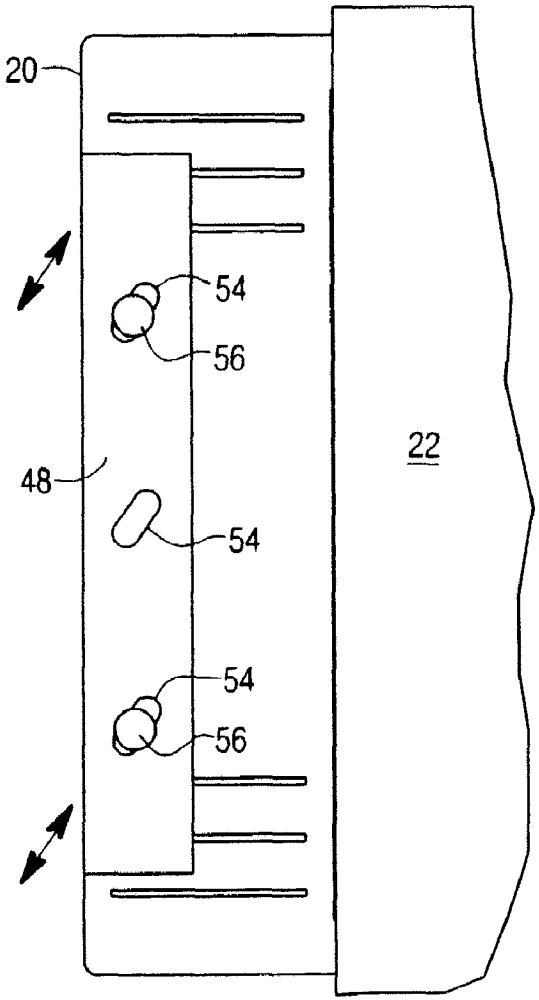
FIG. 7 is a rear view of latch assembly of an open locker door according to an exemplary embodiment.

Referring to FIGS. 1-3, door 20 is attached to frame 18 by one or more hinges 44 and a latch assembly 46. Hinges 44 may be any of a variety of hinge configurations that hingedly couple door 20 to frame 18 (e.g., hinge 44 may be any of a combination of one or more hinges of any type coupling door to box from any side). According to an alternative embodiment, the door is hingedly coupled directly to the side wall 22 or other structure that may support the door.

Latch assembly 46 includes a latch bar (shown as a sliding retaining member 48), a handle 50, and a hasp 120. Retaining member 48 is configured to move between an extended position and a retracted position. In the extended position, retaining member 48 is configured to engage frame 18 to secure door 20 in the closed position. (Preferably, front member 30 is captured or disposed between member 48 and door 20.) In the retracted position, retaining member 48 is configured to disengage from front member 30 so that door 20 may be moved to an open position.

According to a preferred embodiment, retaining member 48 is configured for diagonal movement between the extended position and the retracted position. Retaining member 48 includes one or more slots 54 and is coupled to door 20 by one or more projections 56 (e.g., shoulder bolts, screw or bolt with a nylon bushing, etc.) extending through slots 54. According to a preferred embodiment, retaining member 48 includes recesses around slots 54 to engage or receive a portion of projections 56 and to provide a sliding or bearing surface for the portion of projection 56.

Slots 54 are generally diagonal so that projections 56 guide retaining member 48 in a generally diagonal movement between the extended position (see FIGS. 4 and 5) and the retracted position (see FIG. 1). The weight of retaining member 48 (and attached hardware such as handle 50) and the angle and orientation of slots 54 are intended to urge retaining member 48 in the extended position. According to an exemplary embodiment, slots 54 are angled less than 90 degrees. According to a preferred embodiment, slots 54 are angled between about 20 degrees and about 70 degrees. According to a particularly preferred embodiment, slots 54 are angled approximately 30 degrees from vertical. According to alternative embodiments, the slots may be any of a variety of angles and orientations configured to allow engagement and disengagement of the retaining member and the frame. Additionally, the retaining member may have any number of slot and projection combinations depending on the size and configuration of the door, and desired performance characteristics.

Figure 4:
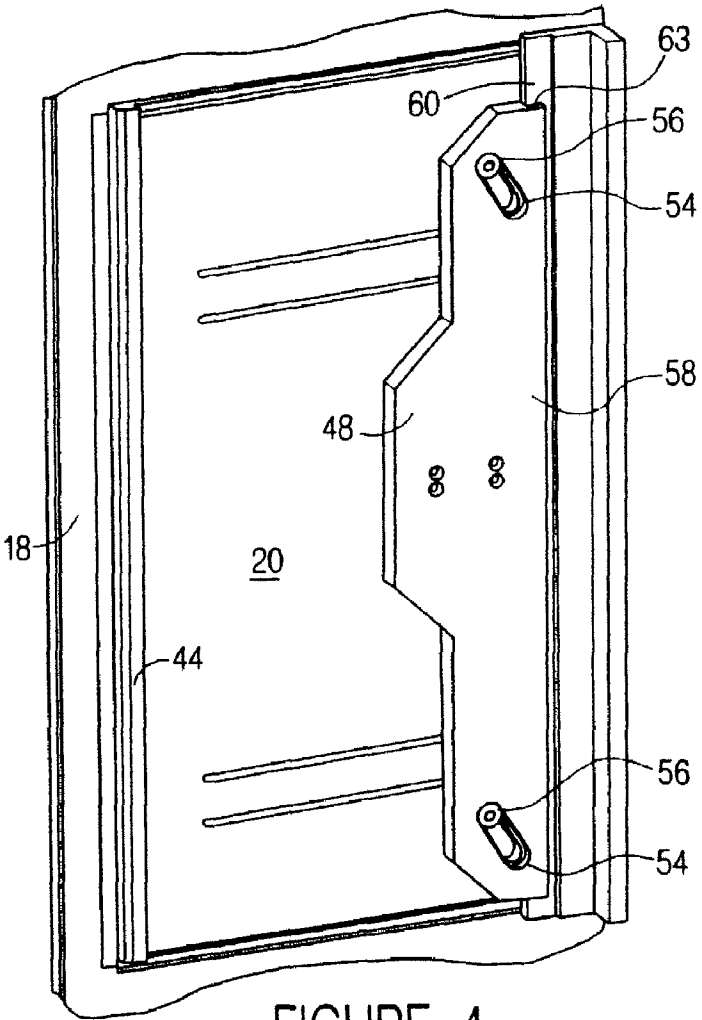
FIG. 4 is a fragmentary perspective view from inside the locker of FIG. 3.
Figure 5:
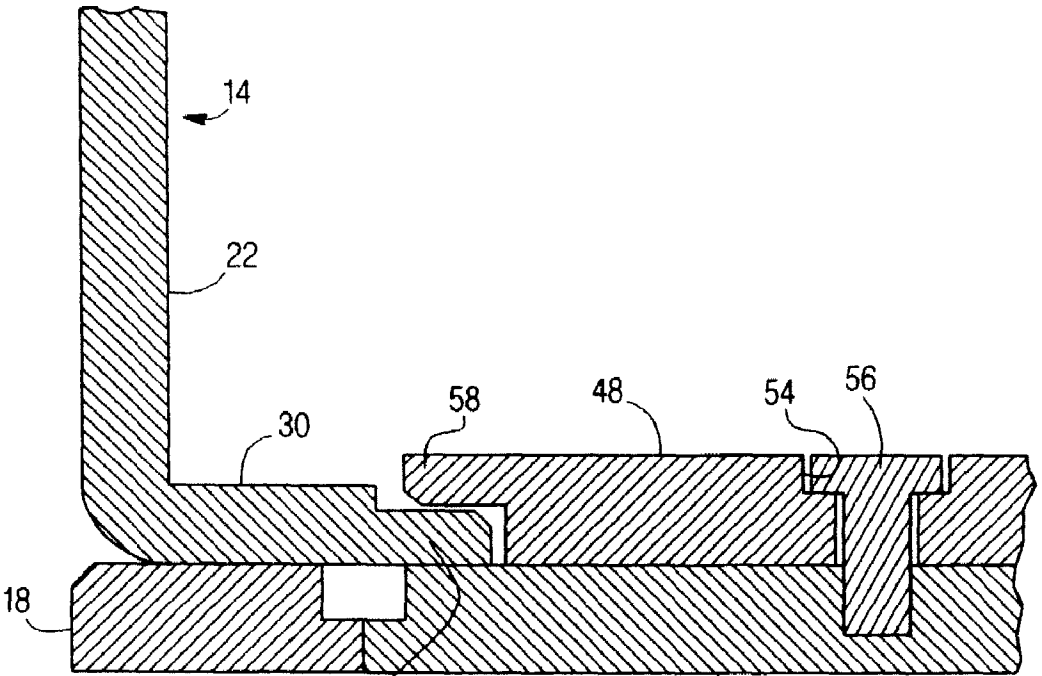
FIG. 5 is a fragmentary section view of a latch assembly for the locker of FIG. 3.

According to a preferred embodiment shown in FIGS. 1, 2, 4, and 5, retaining member 48 includes an interface portion 58 that is configured to engage and disengage an interface portion 59 on front member 30 to secure door 20 in the closed position. As shown in FIG. 5, front member 30 is configured to inhibit door 20 from further rotation into interior space 32 of locker 12. Interface portion 58 and/or 59 may include grooves for improved engagement of retaining member 48 and front member 30.

Figure 8:
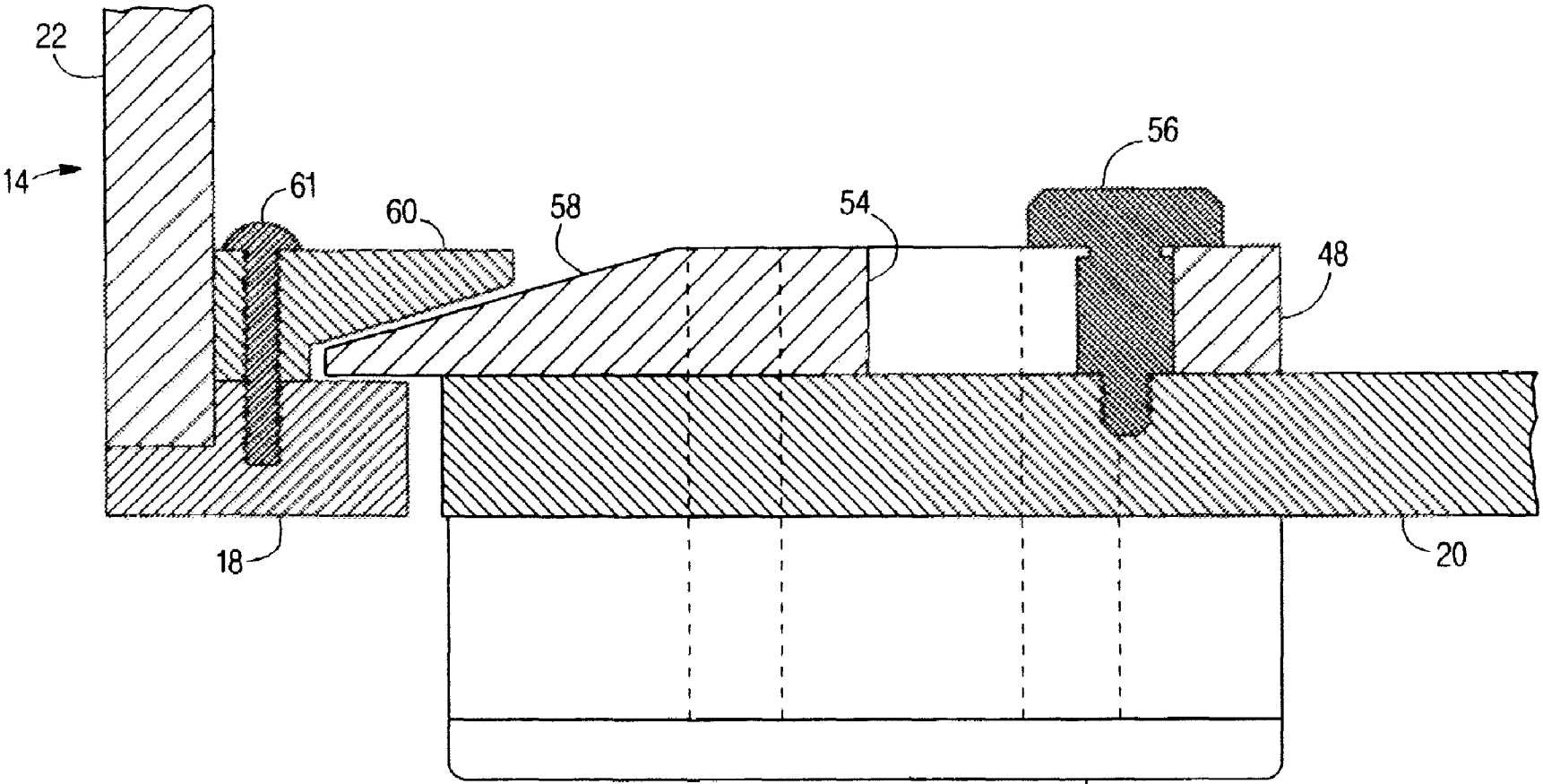
FIG. 8 is a sectional view of the latch assembly of FIG. 6 with the locker door closed.

According to an alternative embodiment shown in FIG. 8, a latch stop 60 is provided as an attached component and configured to couple with retaining member 48 to secure door 20 in the closed position. Latch stop 60 may also be positioned to inhibit door 20 from rotating into interior space 32 of lockers 12. Latch stop 60 may be coupled to frame 18, front members 30, and/or box 14, (e.g., with fasteners 61 (e.g., screw, bolt, pins, etc.), or otherwise secured in place by welding, brazing, heat staking, joining, dovetail slots, adhesive, etc.). Latch stop 60 and frame 18 (or front member 30) define a space configured to receive interface portion 58 to "capture" retaining member 48 when door 20 and latch assembly 46 is secured in a closed position. Latch stop 60 is also configured to inhibit door 20 from rotating into interior space 32 of lockers 12 Latch stop 60 and/or interface portion 58 may have angled surfaces to guide or facilitate engagement.

Referring to FIGS. 4 and 5, retaining member 48 is configured to engage frame 18 and/or front members 30. Alternatively, internal structure such as latch stop 60 may be included to inhibit door 20 from rotating into interior space 32 of lockers 12. According to a preferred embodiment interface position 58 of retaining member 48 includes a flange 63 that defines a groove or notch between interface portion 58 and door 20. (Alternatively, the groove or notch may be between flange 63 and frame 18 or front member 30.) The notch defined by door 20 and flange 63 is configured to receive (e.g., "capture") latch stop 60 when door 20 and latch assembly 46 is secured in the lowered or extended position. Flange 63 may have any of a variety of configurations that are adapted to engage latch stop 60 (e.g., alternating depressions, detents, notches, etc.).

Referring to FIGS. 2 and 6, handle 50 is attached to retaining member 48 through slots 116 so that when handle 50 is raised, retaining member 48 moves in a generally upward direction and away from frame 18 (i.e., between the extended and retracted positions). When handle 50 is released (i.e., when door is in the open or closed position) retaining member 48 is configured to return to the extended position (e.g., due to the weight of handle 50 and retaining member 48, retaining member 48 is biased generally downward due to gravity).

Referring to FIG. 6, handle 50 includes a base portion 110, a grip 112 (shown as a ledge projecting downwardly from base portion 110), and a pair of projections 114 extending from the back of base portion 110. Projections 114 are configured to extend through slots 116 and couple to retaining member 48 (e.g., with fasteners 118, interference fit, etc.). A hasp 120 is coupled to base portion 110 and includes a pair of brackets 122 having apertures 124, 125. According to a preferred embodiment, brackets 122 are "L"-shaped. One of brackets 122 is configured to engage a recess or groove 126 in base portion 110 of handle 50. The other of brackets 122 is configured to reside in a recess 128 in a back surface of door 20 and partially extend through a slot 130 in door 20. As such the aperture 124 on one bracket 122 aligns or registers with aperture 125 on the other bracket 122 when the door 20 is in the closed position and retaining member 48 is in the extended position (e.g., so that a lock can be inserted to lock door 20). To open door 20, the user lifts up on grip 112. Projections 114 slide within diagonal slots 116, and projections 56 slide within slots 54. The angle of slots 116 or slots 54 provide the diagonal (e.g., angular), or horizontal and vertical direction movement of retaining member 48 and handle 50.

According to a preferred embodiment shown in FIGS. 9-12, door 20 and frame 18 are fabricated from a single piece of material by one or more machining operations (e.g., milling, routing, etc.) that remove material from one or both sides of a sheet 62 of material (e.g., plate, blank, etc.). As such, separate sheets of material are not used for a single door and frame assembly, which is intended to reduce waste that would be generated from fabricating frame 18 and discarding material that was the interior or middle portion of the sheet, and would be generated from fabricating door 20 and discarding material that surrounds door 20.

Figure 9:
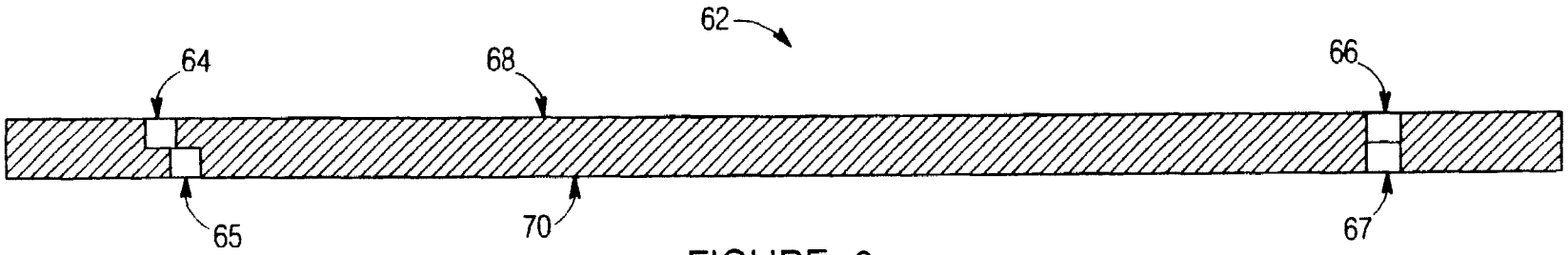
FIG. 9 is a sectional view of a sheet machined to form a door and a frame according to a preferred embodiment.

Referring to FIG. 9, door 20 is formed by grooves 64, 65, 66, 67 that are machined into surfaces 68, 70 of sheet 62. Grooves 64, 66 are located on surface 68 and grooves 65, 67 are located on surface 70 such that groove 64 is partially misaligned with groove 65, and groove 66 is substantially aligned with groove 67 (e.g., offset).

Figure 10:
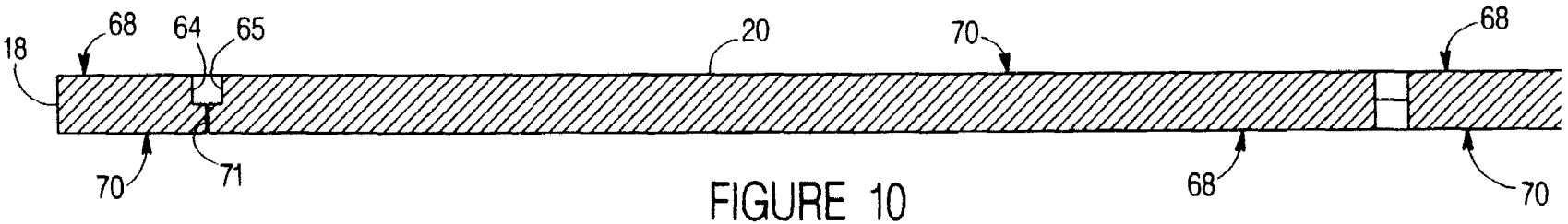
FIG. 10 is a sectional view schematic of the door and frame of FIG. 9 after being aligned for installation.
Figure 12:
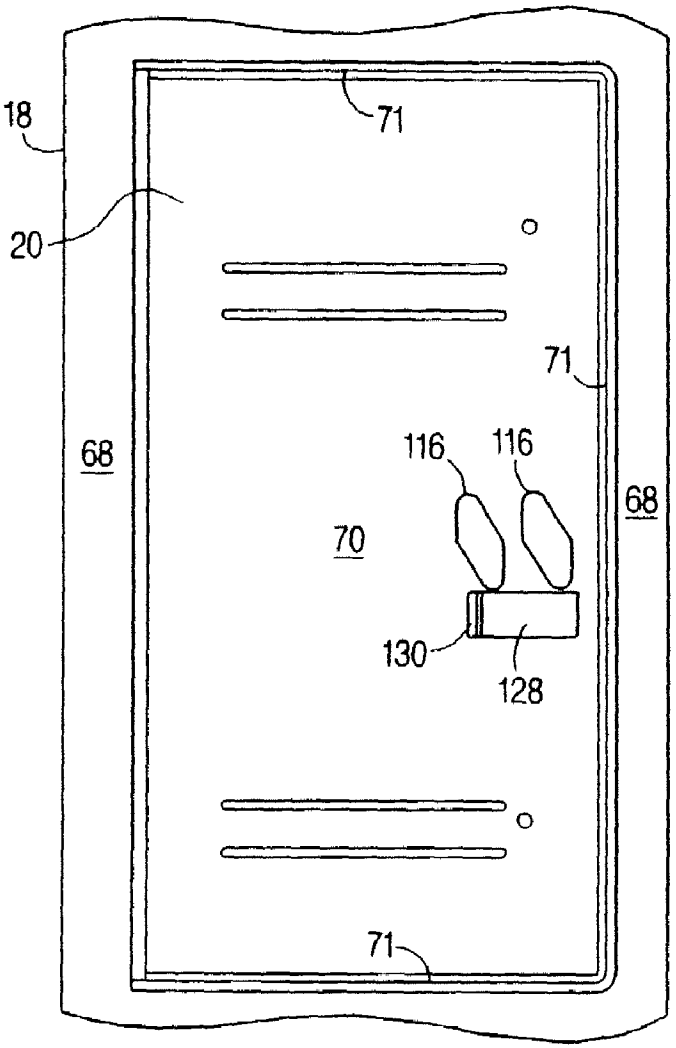
FIG. 12 is an elevation view of the door and frame from inside the locker.
Figure 11:
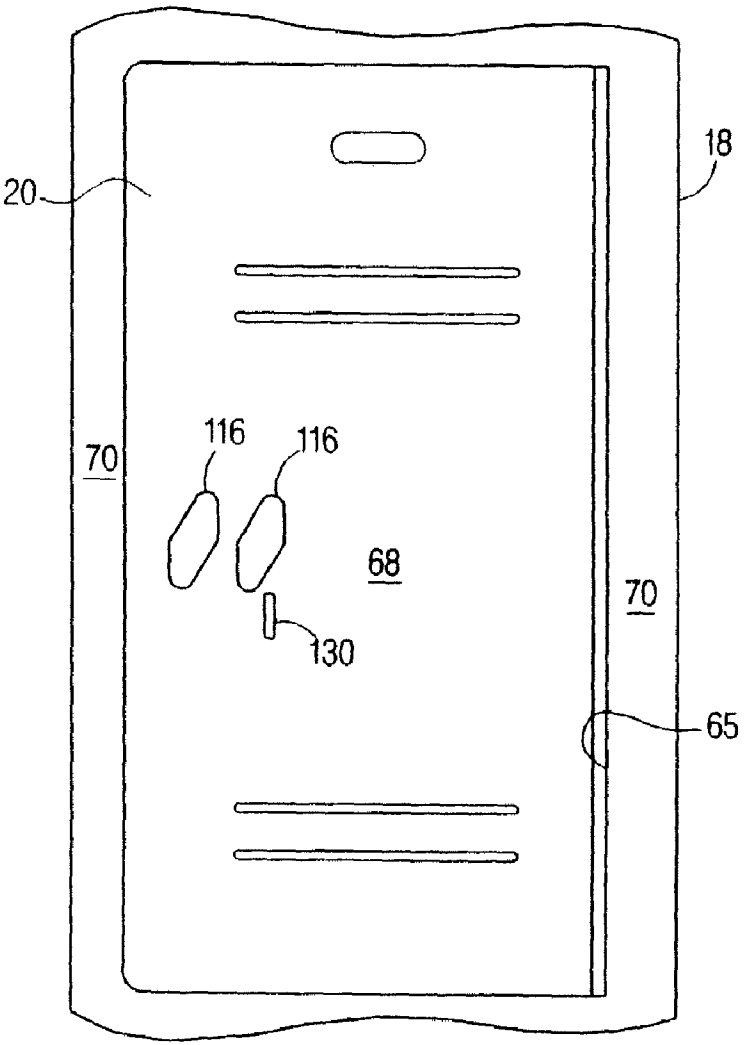
FIG. 11 is an elevation view of the door and frame of FIG. 10 from outside the locker.

Referring to FIG. 10, during assembly of door 20 and frame 18, door 20 is positioned (i.e., reversed and rotated) so that groove 66 remains aligned with groove 67 to provide a clearance slot where hinge 44 is attached, and groove 64 and groove 65 face interior space 32. In the assembled condition, the edges along adjacent grooves 64, 65 are spaced apart a smaller distance (shown as a gap 71) compared to the slot defined by grooves 66, 67. Providing grooves 64, 66 in surface 68, and grooves 65, 67 in surface 70, is intended to allow for use of a standard machining apparatus with a standard tool. The misaligned grooves 64, 65 are intended to allow for a reduced gap between frame 18 and door 20 when door 20 is moved (e.g., rotated and/or shifted) into position.

According to a preferred embodiment, groove 64 and groove 66 overlap between approximately 0.01 inches and 0.02 inches. According to a particularly preferred embodiment, groove 64 and groove 65 overlap approximately 0.016 inches. Alternatively, the grooves overlap more than 1/32 inch. Alternatively, groove 64 and groove 65 overlap between about 1/16 inch and about 1/32 inch. According to alternative embodiments, the grooves may be aligned to provide any of a variety of gaps and/or overlaps between the assembled frame and door according to the desired configuration or performance of the door.

According to an exemplary embodiment, grooves 64, 66 are machined into surfaces 68, 70 with a depth of approximately one-half the thickness of sheet 62. According to a preferred embodiment, grooves 64, 65, 66, 67 have a depth that is more than one-half the thickness of sheet 62. According to a particularly preferred embodiment, grooves 64, 65, 66, 67 have a depth of approximately 0.01 inch greater than one-half the thickness of sheet 62. According to alternate embodiments, the grooves have any of a variety of depths (which may be the same or may be different) that allow for separation of door 20 from frame (e.g., by an additional step).

Figure 13:
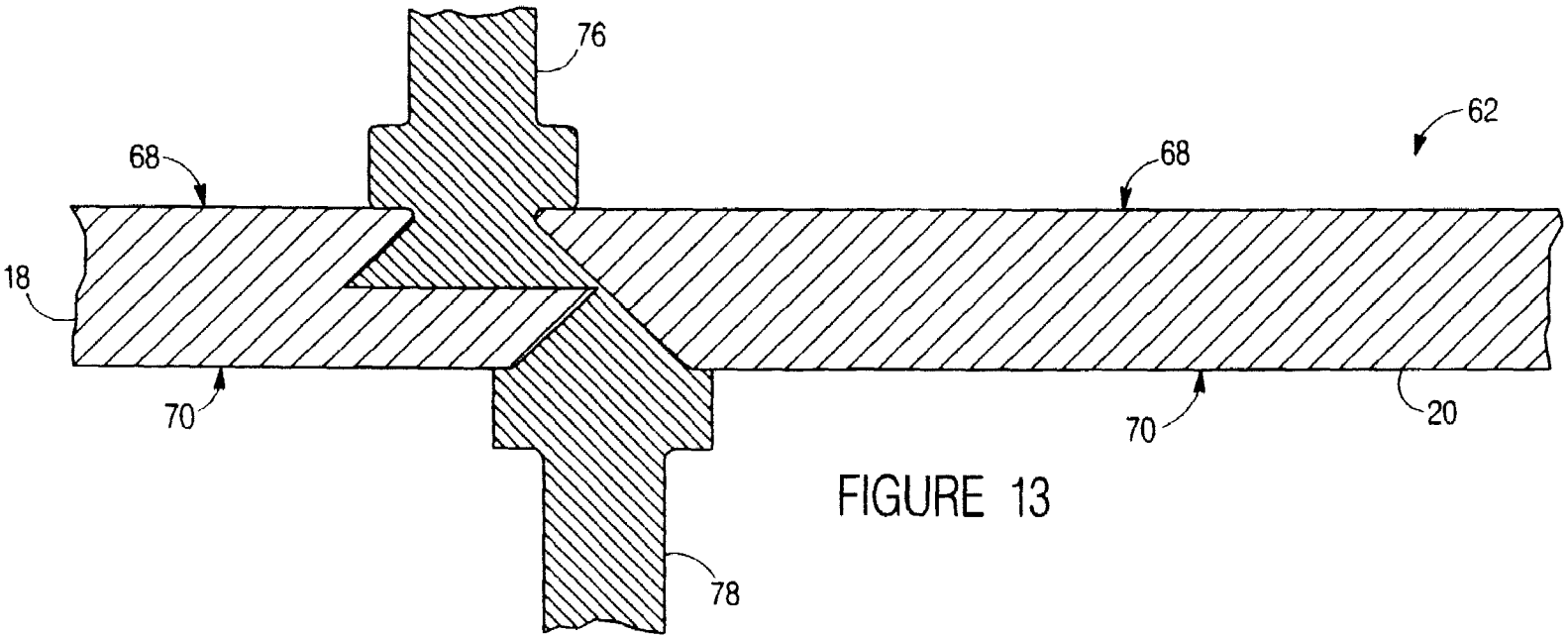
FIG. 13 is a sectional view of a door and frame being machined according to an alternative embodiment.
Figure 14:
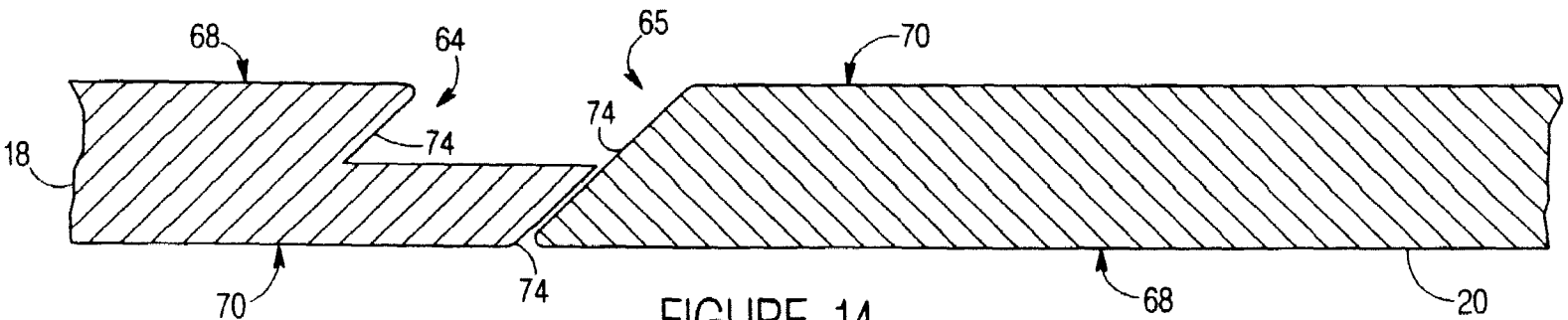
FIG. 14 is a sectional view of the door and frame being machined according to an alternative embodiment.

According to a preferred embodiment, groove 64, 65, 66 and/or 67 have side walls that are generally perpendicular to the surface of sheet 62. According to an alternative embodiment shown in FIGS. 13-15, one or more of the grooves have angled side walls 74 relative to surfaces 68, 70 of sheet 62 (e.g., to provide a dovetail configuration formed by cutting tools 76, 78). As door 20 is positioned (e.g., rotated) during assembly, an interface portion 60 formed by one of angled side walls 74 of frame 18 provides an interference to an interface portion 79 of door 20. According to further alternative embodiments, the grooves may have any of a variety of shapes and configurations according to the desired configuration or performance of the door.

Figure 15:
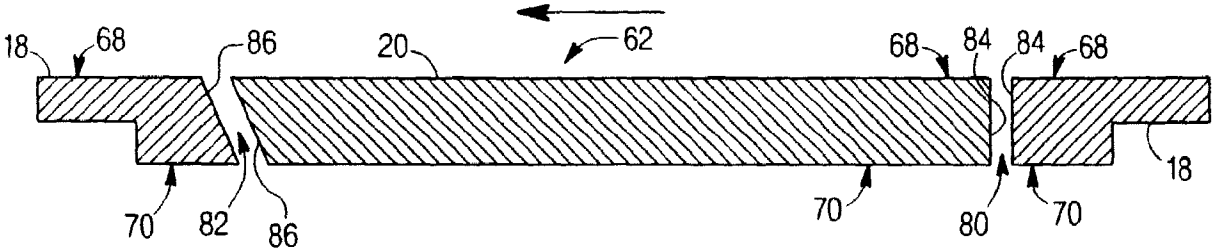
FIGS. 15-18 are sectional views of a door and frame being formed from a single sheet of material before and after being realigned according to alternative embodiments.

According to an alternative embodiment of FIG. 15, door 20 and frame 18 are formed by providing a groove 82 on at least one side of door, and a groove 80 on the other side of door 20. Groove 80 and/or 82 may be formed by one or more operations (e.g., milling, cutting, etc.), depending on whether the grooves are provided on one or both sides of the sheet. Groove 80 includes side walls 84 that are generally perpendicular to surfaces 68, 70 of sheet 62. Groove 82 has side walls 86 that are angled relative to surfaces 68, 70 of sheet. To assemble, door 20 is moved (e.g., shifted) and positioned within frame 18 so that groove 82 becomes smaller and groove 80 becomes larger (wider). Door 20 is shifted about 0.125 inches so that groove 80 opposite groove 82 is about 0.25 inches.

Figure 16:
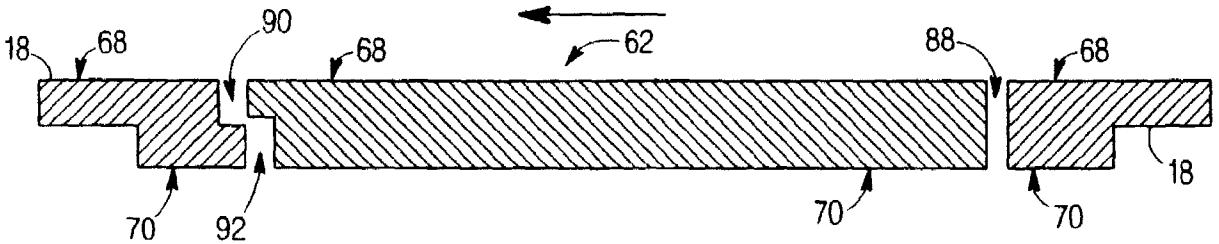

According to an alternative embodiment shown in FIG. 16, door 20 and frame 18 are formed by providing a groove 88 on one or more sides of door 20, and grooves 90, 92 on the other side of door 20. Grooves 88, 90, 92 include side walls 92 that are generally perpendicular to surfaces 68, 70 of sheet 62.

Groove 90, 92 are offset to provide an overlap. To assemble, door 20 is moved (e.g., shifted) and positioned within frame 18 so that grooves 90, 92 become smaller and the overlap becomes larger. Door 20 is shifted about 0.125 inches so that groove 88 opposite grooves 90, 92 is about 0.25 inches.

Figure 17:
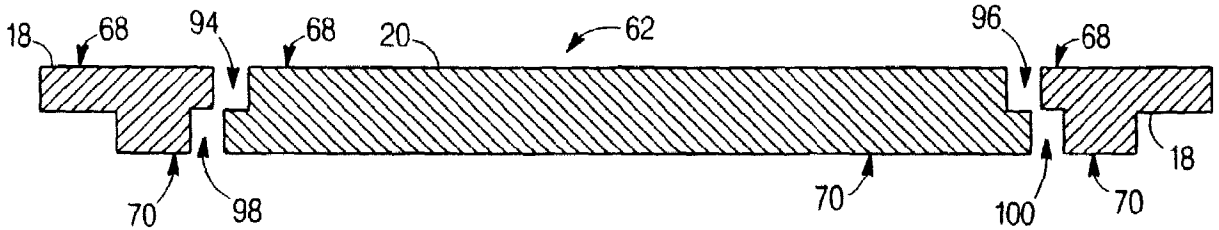
Figure 18:
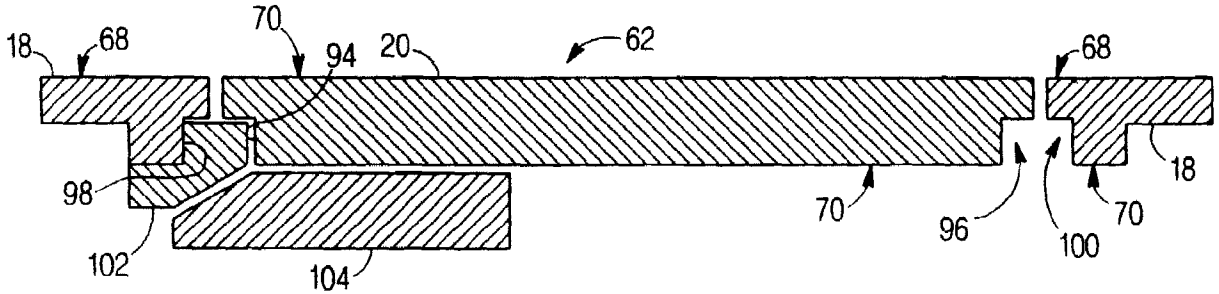
Figure 19:
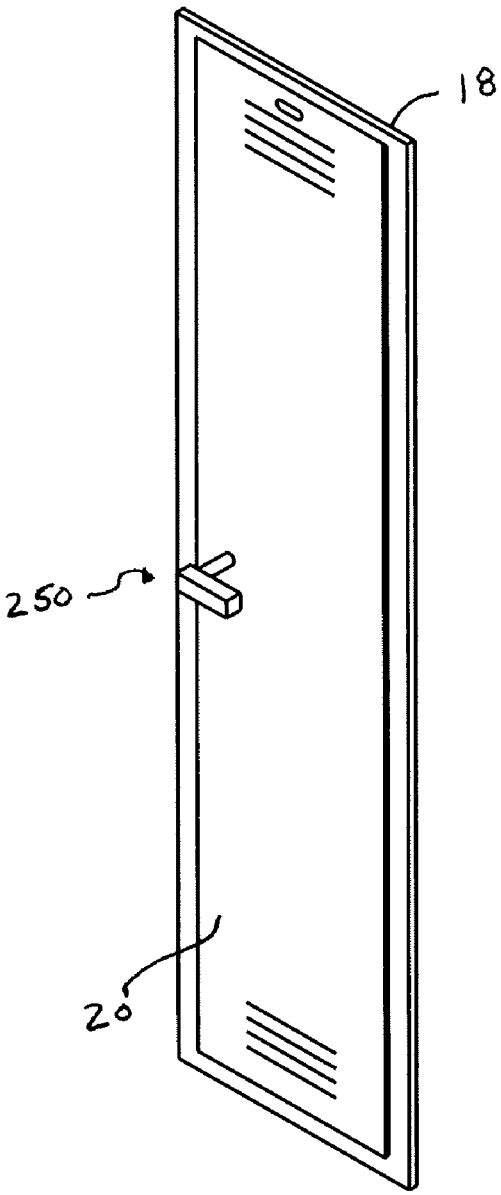
FIG. 19 is a front perspective view of a door and latch assembly according to another exemplary embodiment.

According to an alternative embodiment shown in FIGS. 17 and 18, door 20 and frame 18 are formed by providing grooves 94, 96 on surface 68, and grooves 98, 100 on surface 70 (see FIG. 17). To assemble, door 20 is rotated and positioned within frame 18 so that groove 94 is adjacent 96 and groove 98 is adjacent groove 100 (see FIG. 18). Door 20 opens by rotating about grooves 98, 100 (see arrow in FIG. 18). A latch stop 102 is coupled to frame 18 and retaining member (shown as a latch bar 104) is coupled to door 20 and configured to engage latch stop 102 to secure door 20 in a closed position.

Referring to FIGS. 1 and 2, shelves 34 may be inserted into grooves 38 and held in place by any of a variety of ways (e.g., by frame 18, by an interference fit between shelf 34 and groove 38, adhesive, fasteners, welding, etc. or any combination thereof). According to a preferred embodiment, shelf 34 is located by inserting one side into groove 38 on box 14 at an angle. The other side is pivoted (e.g., slid along the wall) until edges of the shelf is are in the slot in rear wall (e.g., "snaps" into place). After positioning shelf in the desired location (i.e., secured in groove 38 in side walls 22 and back wall), shelf 34 is secured in place (e.g., with welds, adhesives, mechanical fasteners, etc.). According to an exemplary embodiment shown in FIG. 2, divider 36 may be positioned by inserting (e.g., sliding) through a pair of grooves in front members 30 and into a slot in the walls of box 14. An edge of divider 36 remains substantially flush with front side of box 14.

Referring to FIGS. 19 through 23, a latch mechanism or assembly, shown as a latch assembly 246, is shown according to another exemplary embodiment. Latch assembly 246 includes a retaining member (e.g., latch, bar, etc.), shown as a sliding latch bar 248, and a user interface (e.g., manipulation device, etc.), shown as a handle 250. Latch bar 248 is configured to move parallel to door 20 between a first or extended position and a second or retracted position. In the extended position, latch bar 248 is configured to engage the base (e.g., frame 18, etc.) to secure door 20 in the closed position. For example, front member 30 may be captured or disposed between latch bar 248 and door 20. In the retracted position, latch bar 248 is configured to disengage from the base so that door 20 may be moved to an open position.

To facilitate the securement of door 20 in the closed position, the portion of latch bar 248 that engages the base has a length extending in a vertical direction that spans a substantial portion of the height of door 20. The portion of latch bar 248 that engages the base may extend continuously in the vertical direction as shown, or alternatively, may extend intermittently in the vertical direction (e.g., by having gaps or spaces between portions that engage the base, etc.).

Figure 22:
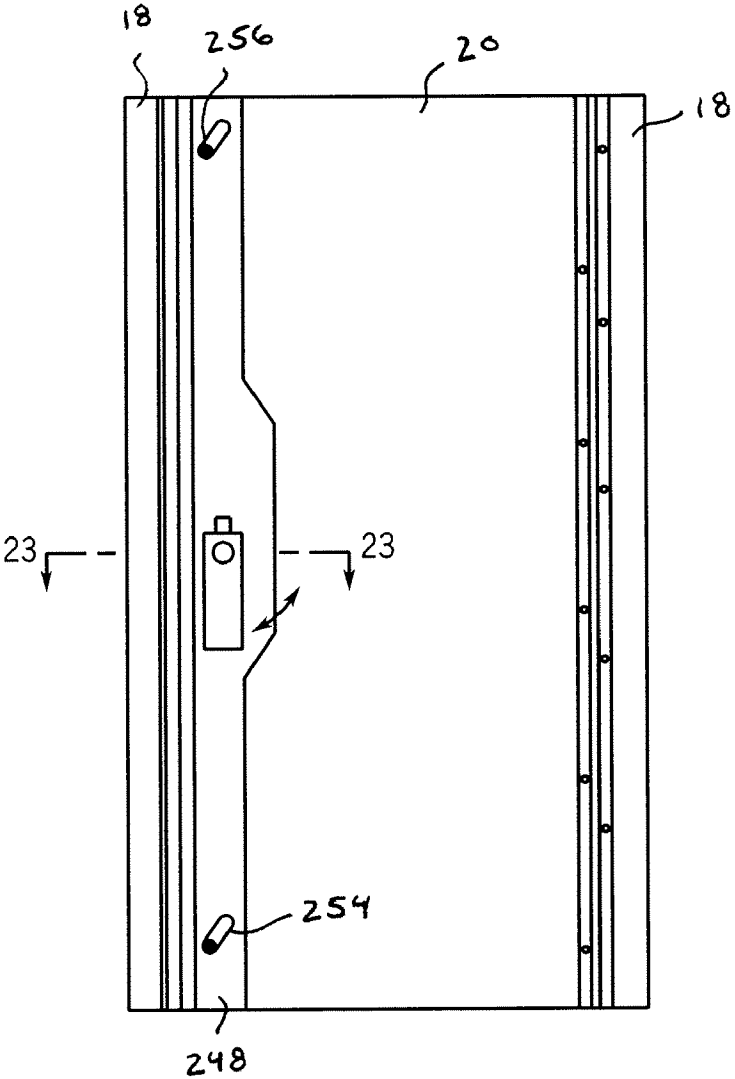
FIG. 22 is a rear elevation view of the door with the latch assembly of FIG. 19 shown in a latched position.
Figure 21:
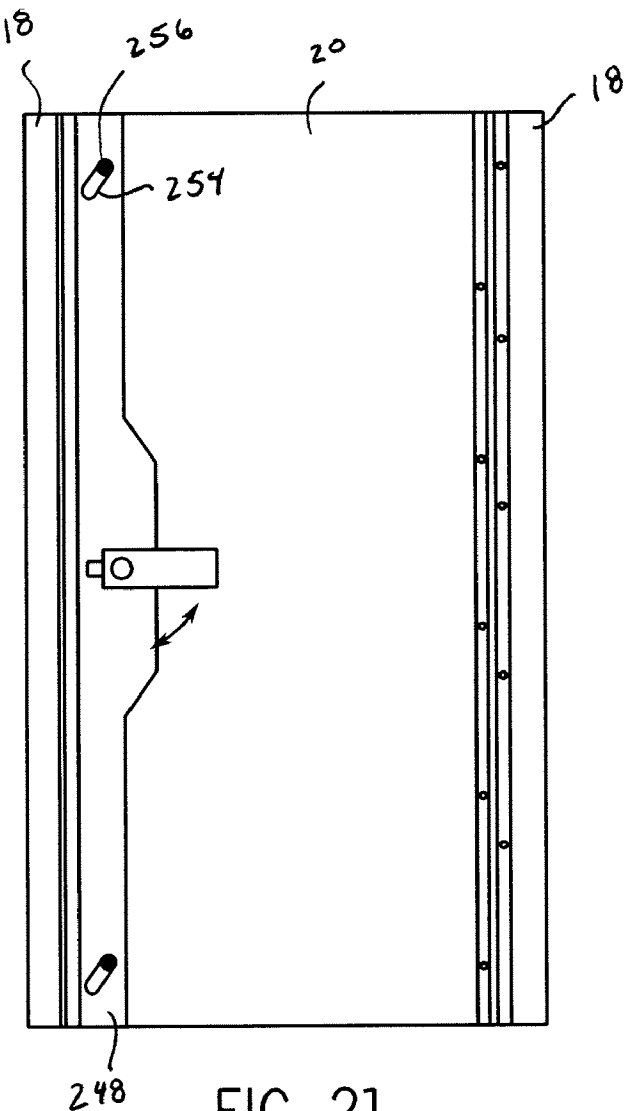
FIG. 21 is a rear elevation view of the door with the latch assembly of FIG. 19 shown in an unlatched position.

According to an exemplary embodiment, the retracted position of latch bar 248 is horizontally and vertically offset from the extended position of latch bar 248. In such an embodiment, latch bar 248 is configured to move in both in a horizontal direction and a vertical direction when moving between the extended position and the retracted position. Referring further to FIGS. 21 and 22, and according to the embodiment illustrated, the movement of latch bar 248 in both the horizontal direction and the vertical direction is a generally continuous diagonal movement. According to the various alternative embodiments, the movement of latch bar 248 in both the horizontal and vertical directions may be non-linear (e.g., curved, arcuate, bowed, discontinuous, etc.) or may be a combination of both linear and non-linear movement. To facilitate the directional movement of latch 248, latch assembly 246 utilizes one or more guides.

According to an exemplary embodiment, the one or more guides are in the form of slots 254. Latch bar 248 includes slots 254 and is coupled to door 20 by one or more projections 256 (e.g., shoulder bolts, screw or bolt with a nylon bushing, etc.) engaging slots 254. Slots 254 may extend completely through latch bar 248 as shown (i.e. a through-slot), or alternatively, may extend on partially through latch bar 248 and take the form of a recess, groove, channel or the like. According to an exemplary embodiment, latch bar 248 includes recesses around slots 254 to engage or receive a portion of projections 256 and to provide a sliding or bearing surface for the portion of projection 256.

According to the embodiment illustrated, slots 254 are generally diagonal so that projections 256 guide latch bar 248 in the generally diagonal movement between the extended position (see FIG. 22) and the retracted position (see FIG. 21). According to the various alternative embodiments, the shape of slots 254 may take any of a variety of forms depending on the desired movement of latch bar 248 (e.g., see FIGS. 26 through 28, etc.). The weight of latch bar 248 and the configuration and orientation of slots 254 are intended to bias or urge latch bar 248 in the extended position. According to the various alternative embodiments, a biasing element (e.g., a spring, etc.) may be provided to assist in urging latch bar 248 in the extended position.

According to an exemplary embodiment, slots 254 are angled less than 90 degrees. According to a preferred embodiment, slots 254 are angled between about 20 degrees and about 70 degrees. According to a particularly preferred embodiment, slots 254 are angled approximately 30 degrees from vertical. According to the various alternative embodiments, the slots may be any of a variety of angles and orientations configured to allow engagement and disengagement of the retaining member and the frame. Additionally, the retaining member may have any number of slot and projection combinations depending on the size and configuration of the door, and desired performance characteristics.

Figure 20:
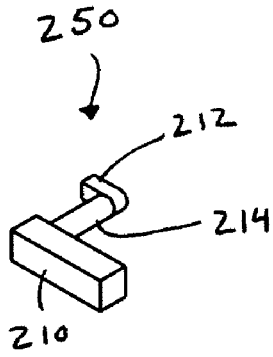
FIG. 20 is a detailed perspective view of a handle of the latch assembly of FIG. 19.
Figure 23:
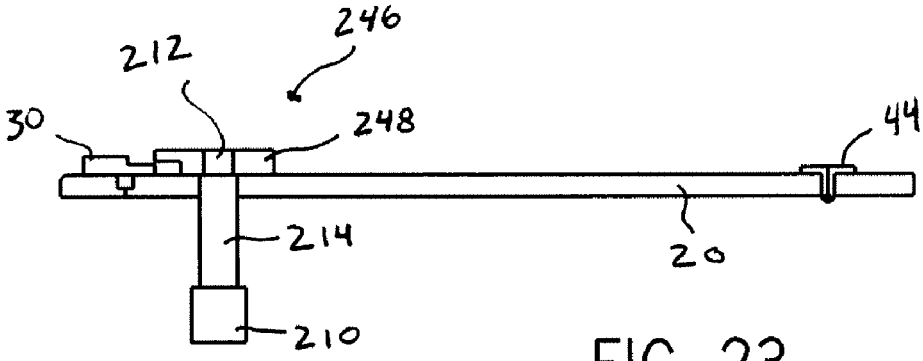
FIG. 23 is a sectional view of the latch assembly of FIG. 19 taken along a line 23-23 in FIG. 22.

Referring to FIG. 20, handle 250 is shown according to an exemplary embodiment. Handle 250 is coupled to latch bar 248 in a suitable manner so that when handle is manipulated (e.g., moved, actuated, etc.) by a user, latch bar 248 will move between the retracted position and the extended position. When handle 250 is released (i.e., when door is in the open or closed position) latch bar 248 is configured to return to the extended position (e.g., due to the weight of handle 250, due to the weight of latch bar 248, due to a biasing force of a spring, etc.). According to an exemplary embodiment, handle 250 is configured for rotation movement relative to door 20. In such an embodiment, the rotation movement of handle 250 causes latch bar 248 to move between the extended position and the retracted position (e.g., move in a generally upward direction and away from frame 18).

According to the embodiment illustrated, handle 250 generally includes a grip portion 210, an operating portion (e.g., key, engagement member, etc.), shown as a cam 212 and a linking or transmission member, shown as a pivot shaft 214, extending from grip portion 210 to cam 212. Pivot shaft 214 is configured to extend through door 20 and defines the axis of rotation for grip portion 210 and/or cam 212 relative to door 20. According to an exemplary embodiment, grip portion 210 is a substantially rectangular member having a first end that is configured to receive pivot shaft 214 and an opposite second end that is configured to be engaged by the user. According to the embodiment illustrated, grip portion 210 is configured to be supported at a substantially horizontal orientation when latch bar 248 is in the extended position.

According to the various exemplary embodiments, the grip portion may have any of a number of configurations and/or may be designed to be supported at any of a number of orientations when latch bar 248 is in the extended position. For example, the grip portion may include one or more contoured surfaces for providing a more ergonomically friendly handle for a typical user (e.g., the grip portion may include one or more curved surfaces for receiving the palm and or fingers of a user, etc.). Also, the grip portion may be in the form of a knob or dial (e.g., a circular dial, etc.) with the pivot shaft positioned centrally or eccentrically thereto.

Still referring to FIG. 20, cam 212 is shown according to an exemplary embodiment. Cam 212 is provided at an end of pivot shaft 214 opposite grip portion 210 and is configured to be supported at an interior side of door 20. Cam 212 is configured to engage (directly or indirectly) latch bar 248 to move latch bar 248 between the extended position and the retracted position when the user rotates grip portion 210. According to the embodiment illustrated, the movement of cam 212 is fixed relative to pivot shaft 214 and grip portion 210. According to the various exemplary embodiments, one or more intermediate members may be provided between cam 212 and pivot shaft 214 such that cam 212 may move relative to pivot shaft 214.

According to an exemplary embodiment, cam 212 is configured to be received by an aperture (e.g., recess, slot, keyhole, groove, channel, etc.) defined by latch bar 248 or an intermediate member. In such an embodiment, cam 212 and the aperture cooperate to transfer the rotation movement of grip portion 210 to a movement that moves latch bar 248 between the extended position and the retracted position. According to the embodiment illustrated, cam 212 and the corresponding aperture cooperate to transfer the rotation movement of grip portion 210 to latch bar 248 in a manner that moves latch bar 248 in both the vertical and horizontal directions.

To open door 20, the user applies a force to grip portion 210 that is sufficient to move latch bar 248 between the extended position and the retracted position. According to an exemplary embodiment, the force must be great enough to overcome the weight of latch bar 248. As detailed above, grip portion 210 is supported at a substantially horizontal orientation when latch bar 248 is in the extended position. According to the embodiment illustrated, the open door 20, the user applies a downward force at the second end of grip portion 210 which causes pivot shaft 214 to rotate relative to door 20 which causes cam 212 to rotate relative to door 20 which causes cam 212 to engage a peripheral surface of the aperture which in turn causes latch bar 248 to move between the extended and retracted position.

The distance that the user must rotate grip portion 210 before latch bar 248 moves from the extended position to the retracted depends upon various design criteria (e.g., the configurations of the latch bar, the cam, the aperture and/or the grip portion, etc.). According to the embodiment illustrated, the user rotates grip portion 210 approximately 90 degrees about pivot shaft 214 to move latch bar 248 from the extended position to the retracted position. According to the various alternative embodiments, grip portion 210 may be configured to rotate distances greater than or less than 90 degrees for allowing door 20 to be opened.

Grip portion 210 may be configured to rotate in either a clockwise or counterclockwise direction to open door 20. According to the embodiment illustrated, the user rotates grip portion 210 in the clockwise direction to open door 20. According to the various alternative embodiments, the arrangement of handle 250 on door 20 may be reversed (e.g., if the location of hinges 44 is moved to an opposite side of door 20, etc.) and a downward force on the gripping portion may cause the grip portion to move in a counterclockwise direction. Further still, the handle may be configured to so that the user must apply an upward force to the grip portion to open the door.

Figure 25:
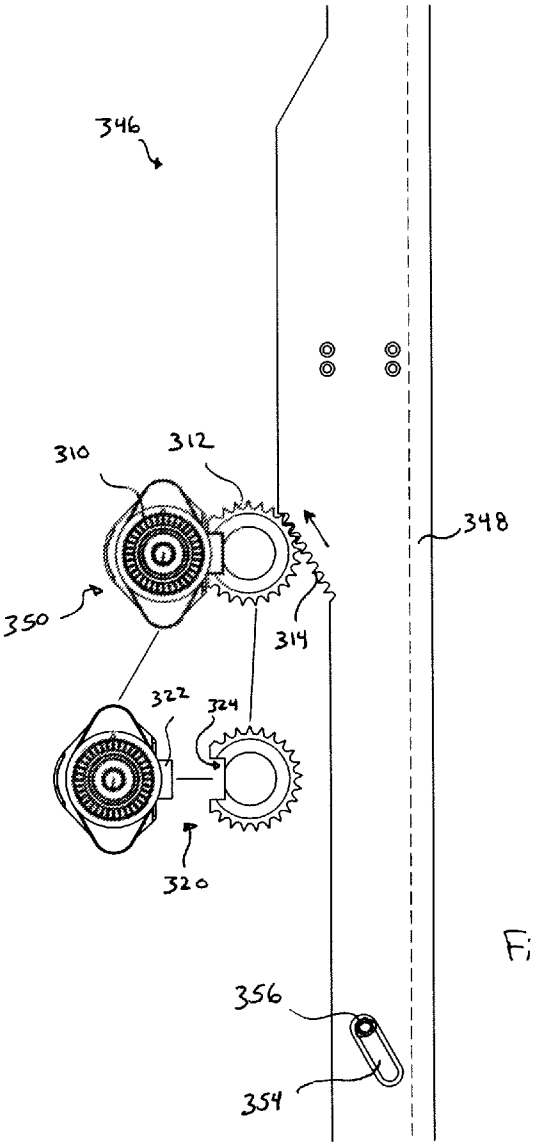
FIG. 25 is an elevation view of the latch assembly of FIG. 24 with a locking device according to an exemplary embodiment.
Figure 24:
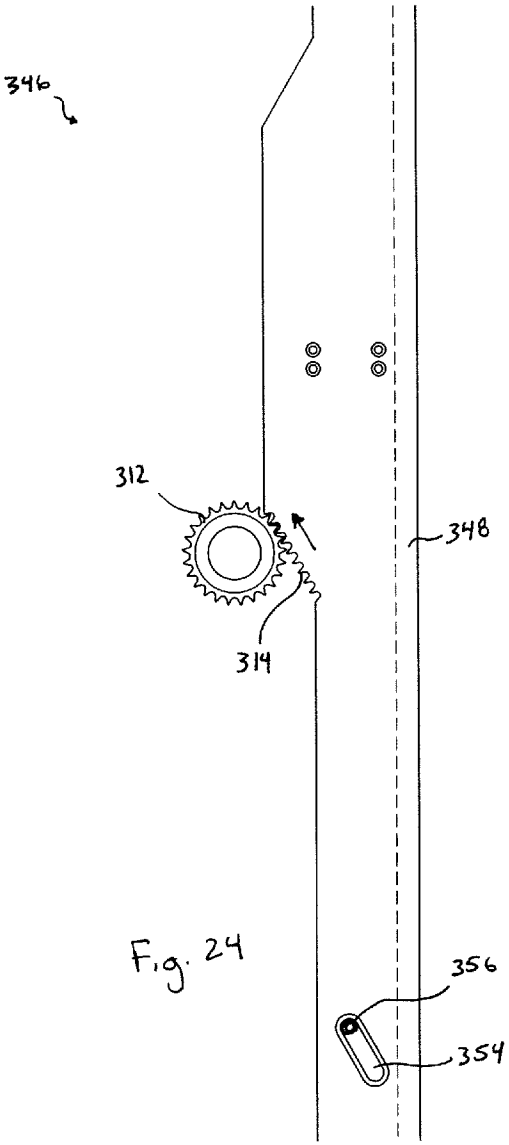
FIG. 24 is an elevation view of a latch assembly according to another embodiment.

Referring to FIGS. 24 and 25, a latch mechanism or assembly, shown as a latch assembly 346, is shown according to another exemplary embodiment. Latch assembly 346 includes a retaining member (e.g., latch, bar, etc.), shown as a sliding latch bar 348, and a user interface (e.g., manipulation device, etc.), shown as a handle 350. Latch bar 348 is configured to move parallel to door 20 between a first or extended position and a second or retracted position. In the extended position, latch bar 348 is configured to engage the base (e.g., frame 18, etc.) to secure door 20 in the closed position. In the retracted position, latch bar 348 is configured to disengage from the base so that door 20 may be moved to an open position.

To facilitate the securement of door 20 in the closed position, the portion of latch bar 348 that engages the base has a length extending in a vertical direction that spans a substantial portion of the height of door 20. The portion of latch bar 348 that engages the base may extend continuously in the vertical direction as shown, or alternatively, may extend intermittently in the vertical direction (e.g., by having gaps or spaces between portions that engage the base, etc.).

According to an exemplary embodiment, latch bar 348 is configured to move in both in a horizontal direction and a vertical direction when moving between the extending position and the retracted position. According to the embodiment illustrated, such movement results in the retracted position being horizontally and vertically offset from the extended position. Referring further to FIGS. 24 and 25, and according to the embodiment illustrated, latch bar 348 is configured for diagonal movement between the extended position and the retracted position. Latch bar 348 includes one or more guides, shown as slots 354, and is coupled to door 20 by one or more projections 356 (e.g., shoulder bolts, screw or bolt with a nylon bushing, etc.) engaging slots 354. Slots 354 may extend completely through latch bar 348 as shown (i.e. a through-slot), or alternatively, may extend on partially through latch bar 348 and take the form of a recess, groove, channel or the like. According to an exemplary embodiment, latch bar 348 includes recesses around slots 354 to engage or receive a portion of projections 356 and to provide a sliding or bearing surface for the portion of projection 356.

According to the embodiment illustrated, slots 354 are generally diagonal so that projections 356 guide latch bar 348 in the generally diagonal movement between the extended position (shown in FIGS. 24 and 25) and the retracted position (not shown). According to the various alternative embodiments, the shape of slots 354 may take any of a variety of forms depending on the desired movement of latch bar 348. The weight of latch bar 348 and the configuration and orientation of slots 354 are intended to bias or urge latch bar 348 in the extended position. According to the various alternative embodiments, a biasing element (e.g., a spring, etc.) may be provided to assist in urging latch bar 348 in the extended position.

According to an exemplary embodiment, slots 354 are angled less than 90 degrees. According to a preferred embodiment, slots 354 are angled between about 20 degrees and about 70 degrees. According to a particularly preferred embodiment, slots 354 are angled approximately 30 degrees from vertical. According to the various alternative embodiments, the slots may be any of a variety of angles and orientations configured to allow engagement and disengagement of the retaining member and the frame. Additionally, the retaining member may have any number of slot and projection combinations depending on the size and configuration of the door, and desired performance characteristics.

Still referring to FIGS. 24 and 25, handle 350 is shown according to an exemplary embodiment. Handle 350 is coupled to latch bar 348 in a suitable manner so that when handle is manipulated (e.g., moved, actuated, etc.) by a user, latch bar 348 will move between the retracted position and the extended position. When handle 350 is released (i.e., when door is in the open or closed position) latch bar 348 is configured to return to the extended position (e.g., due to the weight of handle 350, due to the weight of latch bar 348, due to a biasing force of a spring, etc.). According to an exemplary embodiment, handle 350 is configured for rotation movement relative to door 20. In such an embodiment, the rotation movement of handle 350 causes latch bar 348 to move between the extended position and the retracted position (e.g., move in a generally upward direction and away from frame 18).

According to the embodiment illustrated, handle 350 generally includes a grip portion 310, a first gear 312 and a second gear 314. Grip portion 310 is supported at the exterior of door 20, while first gear 312 and second gear 314 are supported at the interior of door 20. First gear 312 is in meshing engagement with second gear 314. The rotation of grip portion 310 causes the rotation of first gear 312 which causes the movement of second gear 314 relative to first gear 312 which in turn causes latch bar 348 to move between the extended position and the retracted position.

According to an exemplary embodiment, first gear 312 is in the form a pinion and second gear 314 is in the form of a gear rack. By fixing the axis of rotation of first gear 312 relative to door 20, and fixing the movement of second gear 314 relative to latch bar 348, the rotation of first gear 312 causes latch bar 348 to move parallel to door 20 (e.g., between the extended position and the retracted position, etc.).

According to an exemplary embodiment, grip portion 310 is in the form of a knob or dial. A drive shaft (not shown) extends through door 20 between grip portion 310 and first gear 312. The drive shaft may extend directly between grip portion 310 and first gear 312, or alternatively, may extend indirectly via a gear set. For example, the drive shaft may extend directly from grip portion 310 to a third gear (not shown) that is concentrically aligned with the drive shaft and in meshing engagement (directly or through or more intermediate gears) with first gear 312 that is offset from the drive shaft and the third gear. According to the various alternative embodiments, the grip portion may have a configuration similar to that of the various grip portions detailed above.

According to an exemplary embodiment, second gear 314 is coupled to latch bar 348. Second gear 314 is shown as being integrally formed with latch bar 348, but alternatively, may be provided as a separate member that is attached to latch bar 348. According to an exemplary embodiment, the shape of second gear 314 substantially corresponds to the shape of slots 354 to provide for a generally smooth transition of latch bar 348 between the extended and retracted positions. According to the embodiment illustrated, second gear 314 is generally diagonal and extends linearly at an angle less than 90 degrees. According to a preferred embodiment, second gear 314 is angled between about 20 degrees and about 70 degrees. According to a particularly preferred embodiment, second gear 314 is angled approximately 30 degrees from vertical and substantially matches the angle of slots 354. According to the various alternative embodiments, the second gear may be provided at any of a variety of angles and/or orientations. Also, the second gear may be non-linear (e.g., curvilinear, made up of more than one linear segment having different slopes, made up of both curvilinear and linear segments, etc.).

Referring to FIG. 25, handle 350 is further shown as including a locking device 320 for preventing door 20 from being opened. Locking device 320 is shown as having a locking projection 322 supported at grip portion 310 and an aperture 324 defined by first gear 312. With latch bar 348 in the extended position, locking projection 322 can be selectively moved between a first or unlocked position (not shown) and a second or locked position (shown in FIG. 25). In the locked position, locking projection 322 engages aperture 324 to prevent the rotation of first gear 312. Locking device 320 may be configured as a key lock as shown, or alternatively, may be configured as a combination lock, a coin lock or any other known or otherwise suitable lock that is intended to prevent an unauthorized user for moving locking projection 322 from the locked position to the unlocked position.

To open door 20, the user rotates grip portion 310 to move latch bar 348 between the extended position and the retracted position. Rotation of grip portion 310 rotates first gear 312 which causes second gear 314 to walk up first gear 312 and thereby move from the extended position to the retracted position. The distance that the user must rotate grip portion 310 before latch bar 348 moves from the extended position to the retracted depends upon various design criteria (e.g., the configurations of the latch bar and/or the grip portion, the number and size of the gears, etc.).

Figures 26, 27, 28:
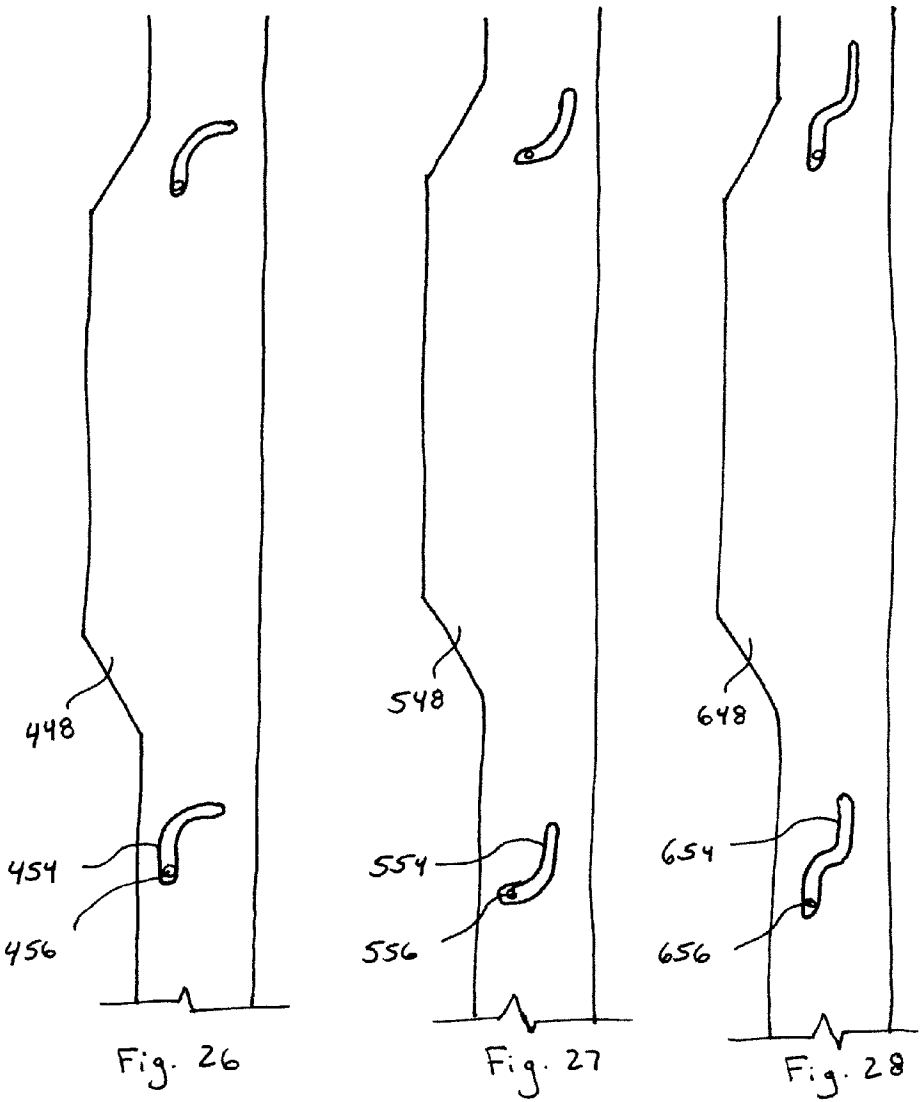
FIG. 26 is an elevation view of a retaining member of a latch assembly according to another embodiment.
FIG. 27 is an elevation view of a retaining member of a latch assembly according to another embodiment.
FIG. 28 is an elevation view of a retaining member of a latch assembly according to another embodiment.

Referring to FIGS. 26 through 28, various latch bars are shown according to exemplary embodiments. Such latch bars are suitable for use with any of the embodiments detailed above. Referring to FIG. 26 in particular, a latch bar 448 is shown having one or more guides, shown as slots 454. Slots 454 are configured to receive one or more projections (e.g., shoulder bolts, screw or bolt with a nylon bushing, etc.) for coupled latch bar 448 to a door. Slots 454 may extend completely through latch bar 448 as shown (i.e. a through-slot), or alternatively, may extend on partially through latch bar 448 and take the form of a recess, groove, channel or the like. Slots 454 are generally non-linear (e.g., arcuate, bowed, having more than one linear line with different slopes, having a combination of linear and non-linear portions, etc.), shown as being curvilinear or curved, and configured to guide the one or more projections so that latch bar 448 is guided in both a vertical direction and horizontal direction when moving between the extended and retracted positions. According to the embodiment illustrated, slots 454 first extend in a substantially upward direction and then extend in a substantially outward direction. In such an embodiment, slots 454 face substantially downwards. The weight of latch bar 448 and the configuration and orientation of slots 454 are intended to bias or urge latch bar 448 in the extended position. Latch bar 448 may have any number of slot and projection combinations depending on the size and configuration of the door, and desired performance characteristics.

Referring to FIG. 27 in particular, a latch bar 548 is shown having one or more guides, shown as slots 554. Slots 554 are configured to receive one or more projections (e.g., shoulder bolts, screw or bolt with a nylon bushing, etc.) for coupled latch bar 548 to a door. Slots 554 may extend completely through latch bar 548 as shown (i.e. a through-slot), or alternatively, may extend on partially through latch bar 548 and take the form of a recess, groove, channel or the like. Slots 554 are generally non-linear (e.g., arcuate, bowed, having more than one linear line with different slopes, having a combination of linear and non-linear portions, etc.), shown as being curvilinear or curved, and configured to guide the one or more projections so that latch bar 548 is guided in both a vertical direction and horizontal direction when moving between the extended and retracted positions. According to the embodiment illustrated, slots 554 first extend in a substantially outward direction and then extend in a substantially upward direction. In such an embodiment, slots 554 face substantially upwards. The weight of latch bar 548 and the configuration and orientation of slots 554 are intended to bias or urge latch bar 548 in the extended position. Latch bar 548 may have any number of slot and projection combinations depending on the size and configuration of the door, and desired performance characteristics. Further, the curvature of the slots may be any of a variety of shapes and/or sizes suitable for providing the desired path of movement for the latch bar.

Referring to FIG. 28 in particular, a latch bar 648 is shown having one or more guides, shown as slots 654. Slots 654 are configured to receive one or more projections (e.g., shoulder bolts, screw or bolt with a nylon bushing, etc.) for coupled latch bar 648 to a door. Slots 654 may extend completely through latch bar 648 as shown (i.e. a through-slot), or alternatively, may extend on partially through latch bar 648 and take the form of a recess, groove, channel or the like. Slots 654 are generally curved and configured to guide the one or more projections so that latch bar 648 is guided in both a vertical direction and horizontal direction when moving between the extended and retracted positions. According to the embodiment illustrated, slots 654 first extend in an upward direction, then extend in an outward direction and then again extend in the upward direction. The weight of latch bar 648 and the configuration and orientation of slots 654 are intended to bias or urge latch bar 648 in the extended position. Latch bar 648 may have any number of slot and projection combinations depending on the size and configuration of the door, and desired performance characteristics. Further, the curvature of the slots may be any of a variety of shapes and/or sizes suitable for providing the desired path of movement for the latch bar.

It should be noted that any references to "front," "back," "rear," "upper," "lower," "right," "left," "interior," and "exterior" in this description are merely used to identify the various elements as they are oriented in the FIGURES, with "right" and "left" being relative to a user position in front of and facing the door of the storage unit. These terms are not meant to limit the element which they describe, as the various elements may be oriented differently in various applications.

It should also be noted that for purposes of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It should further be noted that the terms "storage unit," "locker system," and "locker" are intended to be a broad term and not a term of limitation. The latch assembly may be used with any of a variety of storage unit structures and is not intended to be limited to use with lockers.

The lockers may be provided with any of a variety of additional components, including key locks, built in combination locks, coin operated locks, end panels, solid plastic bases, mesh doors, drawers, bins, engraved logos, number plates, hooks, drawers, trim, and the like.

According to a particularly preferred embodiment, the box top wall, bottom wall, frame, and/or door are made from high density polyethylene ("HDPE"). According to an alternative embodiment, any of a variety of plastic materials may be used (e.g., polypropylene, HDPE, polyethylene, acrylonitrile butadiene styrene ("ABS"), nylon, acrylics, any of a variety of homopolymer plastics, copolymer plastics, plastics with special additives, filled or unfilled, reinforced or unreinforced, etc. According to an alternative embodiment, other materials may be used.

According to a preferred embodiment, the retaining member is made from high density polyethylene ("HDPE"). According to an alternative embodiment, the box may be made from any of a variety of plastic materials (e.g., polypropylene, polyethylene, acrylonitrile butadiene styrene ("ABS"), nylon, acrylics, any of a variety of homopolymer plastics, copolymer plastics, plastics with special additives, filled or unfilled, reinforced or unreinforced, etc.) According to an alternative embodiment, the cap may be made from any of a variety of materials.

It is also important to note that the construction and arrangement of the elements of the latch mechanism as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, while the components of the disclosed embodiments will be illustrated as a locker, the features of the disclosed embodiments have a much wider applicability. The latch mechanism is adaptable for other storage units, bins, containers, and other office, home, or educational products which employ a storage space with a door. Further, the size of the various components and the size of the containers can be widely varied. Also, the particular materials used to construct the exemplary embodiments are also illustrative. For example, extruded high density polyethylene is the preferred method and material for making the top and base, but other materials can be used, including other thermoplastic resins such as polypropylene, other polyethylenes, acrylonitrile butadiene styrene ("ABS"), polyurethane nylon, any of a variety of homopolymer plastics, copolymer plastics, plastics with special additives, filled plastics, etc. Also, other molding operations may be used to form these components, such as blow molding, rotational molding, etc. Further, the placement of the projections and the slots relating to the latch bar may be reversed. For example, the slots may be defined by a portion of the door while the projections are supported by the latch bar. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A locker comprising:

a base defining a storage space;

a door coupled to the base and rotatable relative to the base between an open position and a closed position;

a latch bar supported at an interior side of the door by at least one projection that engages at least one guide slot in the latch bar, the latch bar being moveable parallel to the door between an extended position and a retracted position, the latch bar being a one-piece bar that is configured to directly engage the base when in the extended position to secure the door in the closed position; and a handle accessible from an exterior side of the door and configured for rotational movement, wherein the rotational movement of the handle causes the latch bar to move between the extended position to the retracted position thereby disengaging the latch bar from the base and allowing the door to be moved to the open position, wherein the latch bar is biased toward the extended position, the extended position being horizontally and vertically offset from the retracted position.

2. The locker of claim 1 wherein the latch bar has a weight that biases the latch bar toward the extended position.

3. The locker of claim 1 wherein the at least one guide slot includes a plurality of guide slots.

4. The locker of claim 1 wherein the at least one guide slot is curved.

5. The locker of claim 4 wherein the at least one guide slot extends outward and then upward.

6. The locker of claim 4 wherein the at least one guide slot extends upward and then outward.

7. The locker of claim 1 wherein the at least one guide slot is a through-slot extending completely through the latch bar.

8. The locker of claim 1 wherein the latch bar is configured to directly engage an inner surface of a front member of the base to secure the door in the closed position.

9. The locker of claim 1 wherein the latch bar comprises a first portion including the at least one guide slot and a second portion configured to engage the base to secure the door in the closed position.

10. The locker of claim 1 wherein the handle is configured to be rotated by a user approximately 90 degrees to move the latch bar between the extended position and the retracted position.

11. The locker of claim 1 wherein the handle projects outward from the exterior side of the door.

12. The locker of claim 1 wherein the handle includes a grip portion configured to be supported at a substantially horizontal orientation when the latch bar is in the extended position.

13. The locker of claim 12 wherein the handle is configured to be rotated by a user in a downward direction to move the latch bar between the extended position and the retracted position.

14. The locker of claim 12 wherein the handle is manipulated by rotating the grip portion of the handle relative to the door.

15. The locker of claim 1 further comprising a cam coupled to the handle and engaging the latch bar, wherein engagement of the cam with the latch bar causes the latch bar to move between the extended position and the retracted position.

16. The locker of claim 1 further comprising a first gear coupled to the handle and a second gear in meshing engagement with the first gear, wherein rotation of the handle rotates the first gear which moves the second gear and causes the latch bar to move between the extended position and the retracted position.

17. The locker of claim 16 wherein the second gear is supported at a peripheral edge of the latch bar.

18. The locker of claim 17 wherein the second gear portion is in the form of a substantially linear gear rack that extends diagonally at a first orientation.

19. The locker of claim 18 wherein the at least one guide slot extends diagonally at substantially the first orientation.

20. The locker of claim 16 further comprising a locking device configured to selectively engage the first gear to prevent the latch bar from moving between the extended position and the retracted position.

21. The locker of claim 20 wherein the locking device includes a locking tab coupled to the handle and configured to selectively engage an aperture in the first gear.

22. A locker comprising:

a base;

a door coupled to the base and rotatable relative to the base between an open position and a closed position;

a latch bar supported at an interior side of the door by at least one projection that engages at least one guide in the latch bar, the latch bar being moveable parallel to the door between an extended position and a retracted position, the latch bar being a one-piece bar that is configured to directly engage the base when in the extended position to secure the door in the closed position; and a handle accessible from an exterior side of the door and configured for rotational movement, wherein the rotational movement of the handle causes the latch bar to move between the extended position to the retracted position thereby disengaging the latch bar from the base and allowing the door to be moved to the open position, the extended position being horizontally and vertically offset from the retracted position.

23. The locker of claim 22 wherein the at least one guide is a slot.

24. The locker of claim 22 further comprising a cam coupled to the handle and configured to engage the latch bar, wherein rotation of the handle rotates the cam into engagement with the latch bar thereby causing the latch bar to move between the extended position and the retracted position.

25. The locker of claim 22 further comprising a first gear coupled to the handle and a second gear in meshing engagement with the first gear, wherein rotation of the handle rotates the first gear which moves the second gear and causes the latch bar to move between the extended position and the retracted position.

26. The locker of claim 25 wherein the second gear is in the form of a gear rack that is integrally formed with the latch bar as a one-piece unitary member.

27. The locker of claim 26 wherein the second gear extends in both a horizontal direction and a vertical direction.

28. The locker of claim 27 wherein the second gear extends diagonally.

29. The locker of claim 28 wherein the at least one guide slot extends diagonally at substantially the same angle as the second gear.

30. The locker of claim 25 further comprising a locking device configured to selectively engage the first gear to prevent the latch bar from moving between the extended position and the retracted position.

31. The locker of claim 30 wherein the locking device includes a locking tab coupled to the handle and configured to selectively engage an aperture in the first gear.

32. The locker of claim 24 wherein the cam is received within a slot defined by the latch bar.

33. A locker comprising:

a base;

a door coupled to the base and rotatable relative to the base between an open position and a closed position;

a latch bar supported at an interior side of the door and moveable parallel to the door between an extended position and a retracted position, the latch bar being a one-piece member that is configured to directly engage the base when in the extended position to secure the door in the closed position;

a handle accessible from an exterior side of the door and configured for rotational movement, wherein the rotational movement of the handle causes the latch bar to move between the extended position to the retracted position thereby disengaging the latch bar from the base and allowing the door to be moved to the open position; and a cam coupled to the handle and configured to engage the latch bar, wherein the rotational movement of the handle rotates the cam into engagement with the latch bar thereby causing the latch bar to move between the extended position and the retracted position, the extended position being horizontally and vertically offset from the retracted position.

34. The locker of claim 33 wherein the cam is rotationally fixed relative to the handle.

35. The locker of claim 33 wherein the cam is received within a slot defined by the latch bar.

36. The locker of claim 33 wherein the handle is configured to be rotated by a user approximately 90 degrees to move the latch bar between the extended position and the retracted position.

* * * * *